United States Patent [19]

Altenpohl et al.

[11] 3,988,874

[45] Nov. 2, 1976

[54] POULTRY WEIGHING AND PACKING APPARATUS

[76] Inventors: William F. Altenpohl; Paul J. Altenpohl, both of Union Hill Road, West Conshohocken, Pa. 19428

[22] Filed: Apr. 22, 1975

[21] Appl. No.: 571,005

[52] U.S. Cl. ..... 53/59 W; 53/62; 53/142; 53/164; 235/92 SA; 235/92 WT; 235/98 R

[51] Int. Cl.[2] ..... B65B 57/20; G06M 7/04

[58] Field of Search ..... 53/59 W, 61, 62, 164, 53/142, 244, 250; 235/98 R, 92 SA, 92 WT

[56] References Cited

UNITED STATES PATENTS

| | | | |
|---|---|---|---|
| 2,998,190 | 8/1961 | Rosenberg et al. | 235/92 SA |
| 3,031,810 | 5/1962 | MacLeod | 53/62 |
| 3,069,823 | 12/1962 | Schmid | 53/62 X |
| 3,201,912 | 8/1965 | Wozniak | 53/61 |
| 3,492,779 | 2/1970 | Russel | 235/98 R X |
| 3,570,209 | 3/1971 | Salwasser | 53/62 X |
| 3,622,017 | 11/1971 | Meuller | 235/98 R X |
| 3,652,833 | 3/1972 | Shigemori | 235/98 R X |

*Primary Examiner*—Leon Gilden
*Attorney, Agent, or Firm*—Clarence A. O'Brien; Harvey B. Jacobson

[57] ABSTRACT

Poultry dropped from a conveyor line at a weighing station is automatically packed into containers by a container filling machine positioned below the weighing station. The birds received in the machine from the weighing station are rammed into an accumulator from which they are dropped into a container that is supported and periodically reorientated on a turntable. When fully loaded, the container is displaced from the turntable by an empty container to begin another operational cycle. Signal feedback sensors and control logic govern automatic operation of the machine through fluid power operated devices.

13 Claims, 25 Drawing Figures

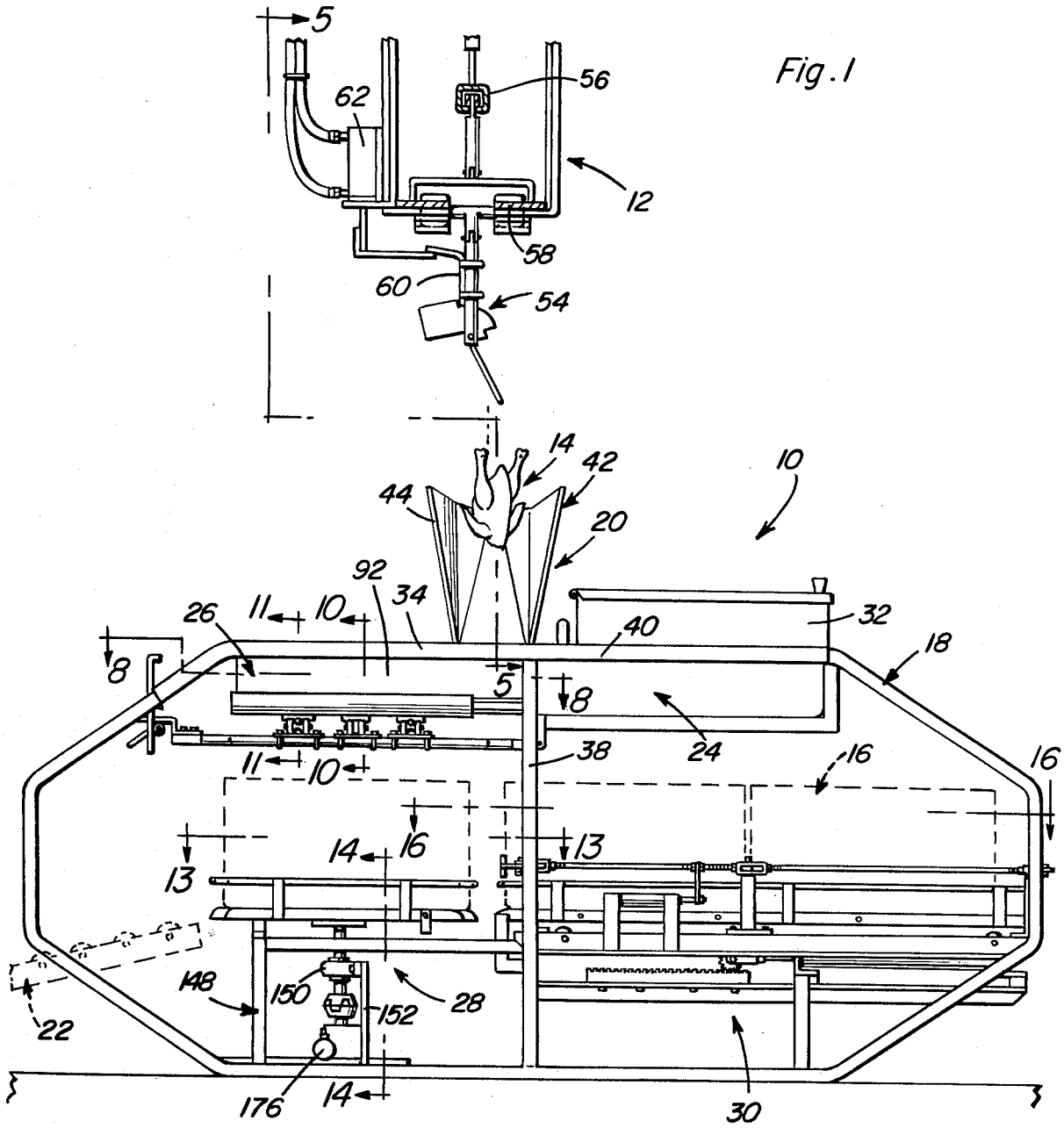
Fig. 1
Fig. 4
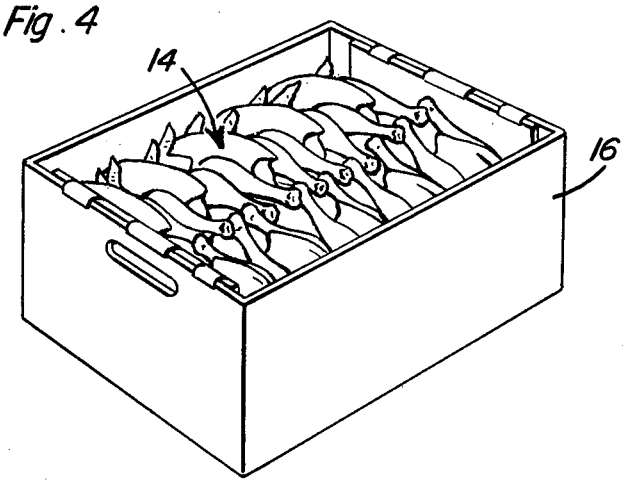

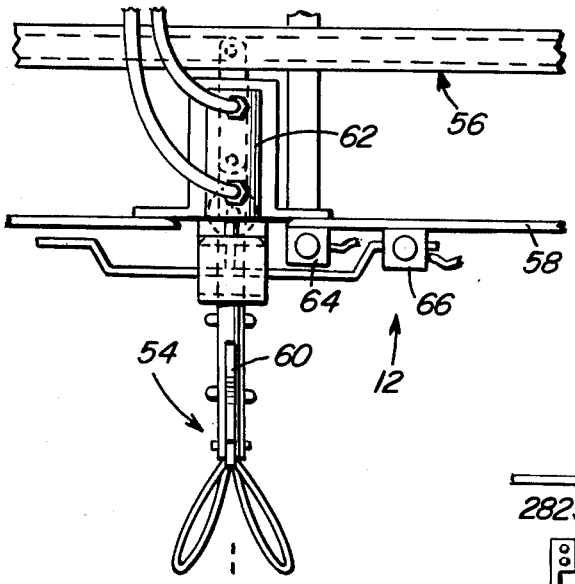
Fig. 5
Fig. 20
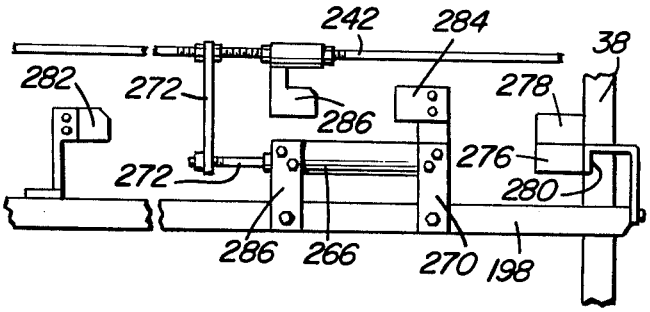
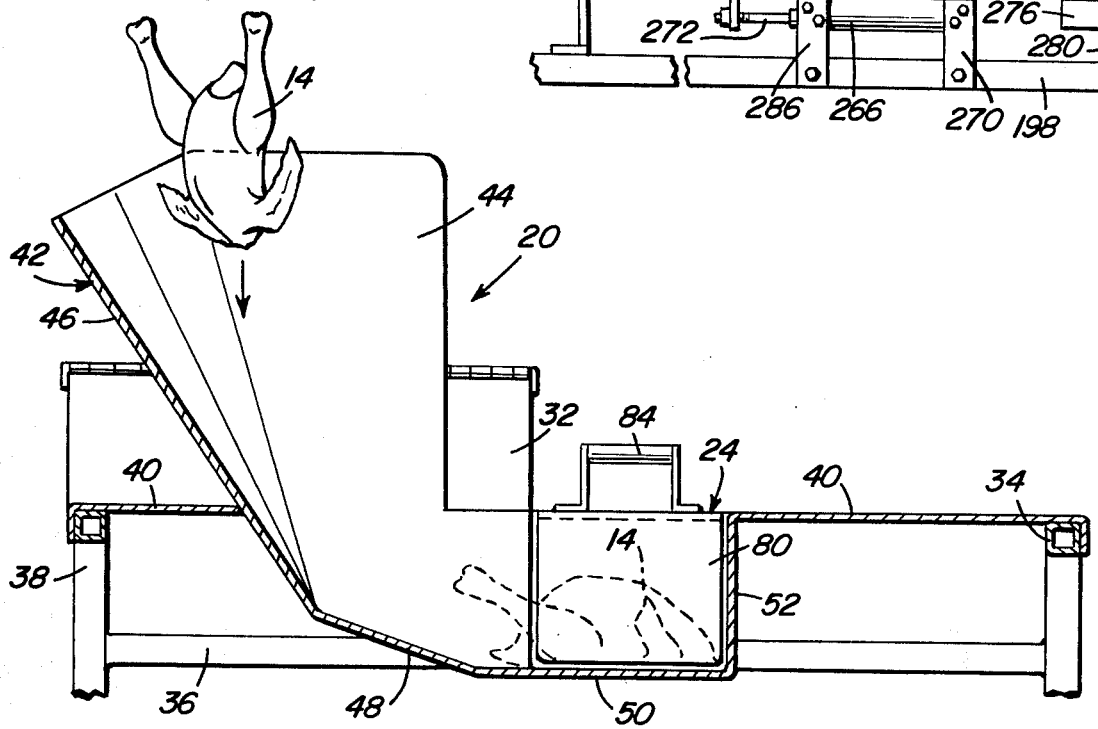
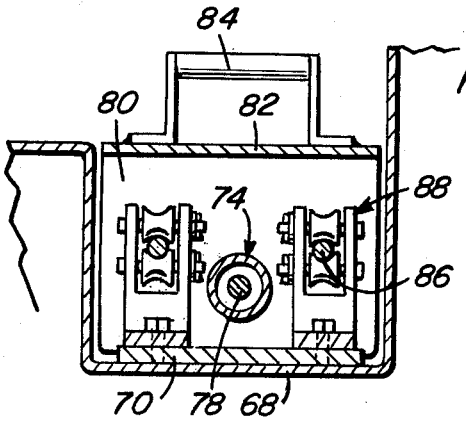
Fig. 7
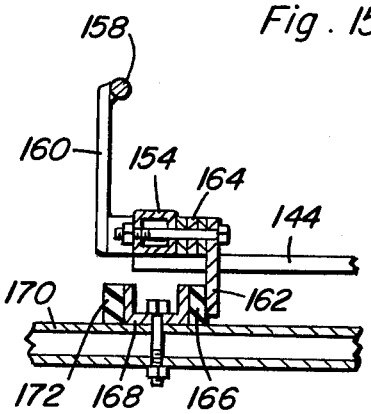
Fig. 15

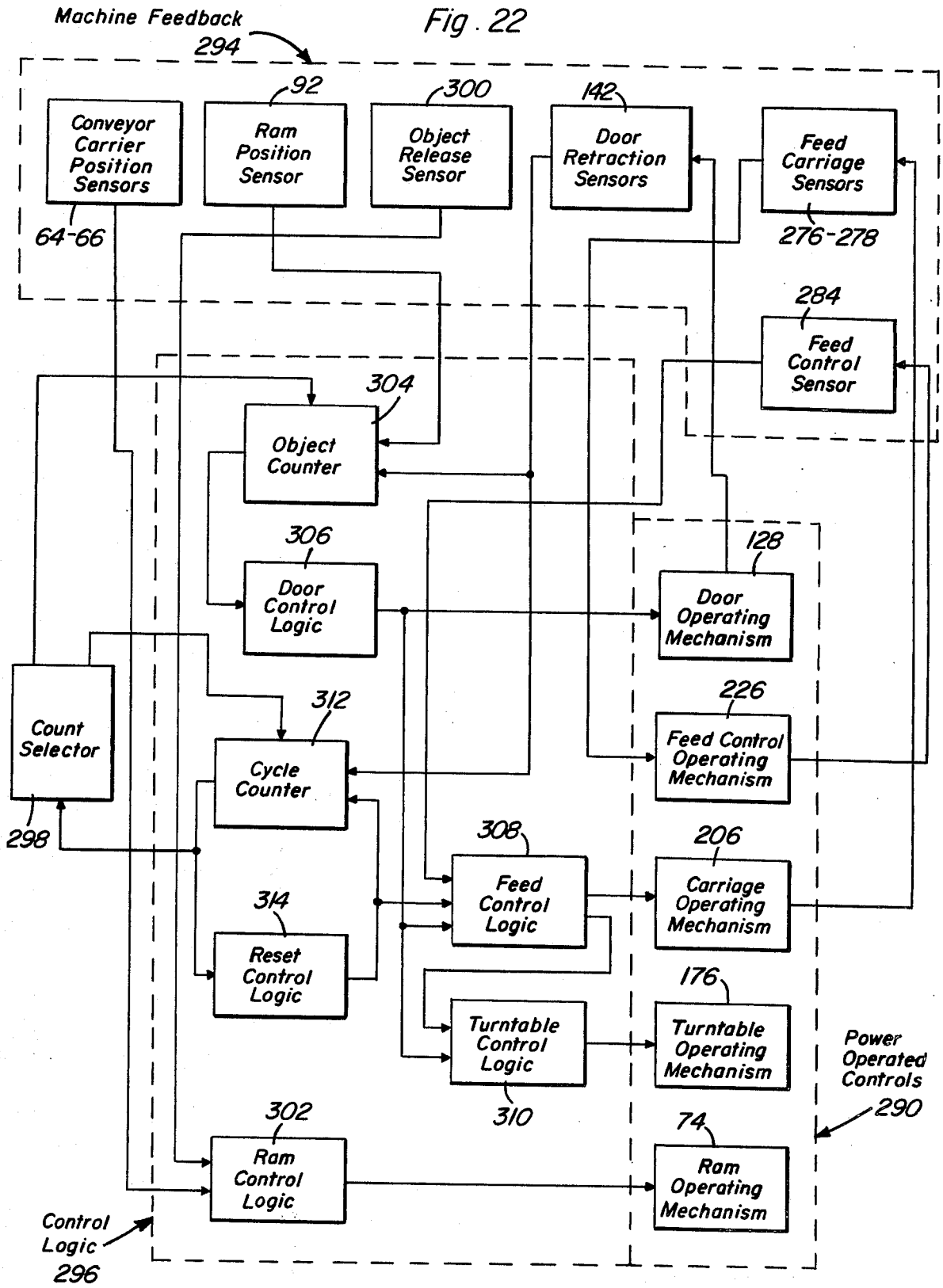
Machine Feedback
294
Fig. 22
Conveyor Carrier Position Sensors
64-66
Ram Position Sensor
92
Object Release Sensor
300
Door Retraction Sensors
142
Feed Carriage Sensors
276-278
284
Feed Control Sensor
304
Object Counter
306
Door Control Logic
128
Door Operating Mechanism
226
Feed Control Operating Mechanism
Count Selector
298
312
Cycle Counter
308
Feed Control Logic
206
Carriage Operating Mechanism
314
Reset Control Logic
176
Turntable Control Logic
Turntable Operating Mechanism
310
Power Operated Controls
290
302
Ram Control Logic
74
Ram Operating Mechanism
Control Logic
296

APPARATUS
POULTRY WEIGHING AND PACKING

BACKGROUND OF THE INVENTION

This invention relates to the weighing and packing of poultry in general and more particularly to the automatic packing of poultry, that is weight sorted, into containers for shipment from a poultry processing plant.

According to present methods, poultry is carried by an overhead conveyor in a poultry processing plant through weight sorting stations at which the poultry is automatically dropped into packing bins. Manual labor is utilized to transfer the poultry from these bins into containers such as wooden or paper board boxes. The birds are generally packed into the containers in layers with each layer formed by two rows of birds with the legs orientated toward the center of the box. The number of birds in each row for a given size container depends upon the weight range or size of the birds necessary to load the container to a desired weight. Thus, in addition to counting the number of birds in each row loaded into the container, the packer must also count the number of layers as well as an additional or supplemental number of birds added after the top layer is formed in order to closely approximate the minimum weight of the loaded container. For example, where a packer is to fill a container with birds weighing three pounds each so as to approximate a minimum load of 65 pounds, 22 birds must be counted out. The birds must be placed in two rows of five birds each to form two layers or tiers with two additional birds placed on the top layer. The loaded container is then placed by the packer on a roller conveyor for weighing and recording at a scale station. The container is then packed with ice before it is closed in an automatic box closing machine.

It will be appreciated that the foregoing procedure in packing containers with poultry received from weight sorting packing bins is quite costly and often unreliable because of the use of manual labor. Often, boxes are filled with incorrectly sized birds or with an incorrect count. Another disadvantage resides in the weight and heat loss from the birds as they lay in the sorting bins because of the time it takes to pack the birds into the boxes. This time factor also limits the capacity of the conveyor line extending through the weight sorting stations. For example, a conveyor line having a capacity of 6,000 birds per hour in connection with the weight sorting and grading of the birds, may require as many as seven packers.

It is therefore an important object of the present invention to provide a method of automatically packing birds dropped from an automatic weight sorting conveyor into conventional containers and in accordance with the packing arrangement heretofore accomplished manually. In accordance with the foregoing object, an additional object of the present invention is to provide a method and apparatus for automatically packing preselected numbers of birds ordinarily collected within weight sorting bins into standard size containers, each container receiving a number of birds preselected in accordance with its weight range in order to fill each container with a number of birds which will closely approximate the desired minimum weight for each container when loaded.

Machine operation methods and apparatus for the automatic handling of objects to be packed into containers, are generally well known as disclosed for example in U.S. Pat. Nos. 2,552,620 and 3,512,336. U.S. Pat. No. 2,552,620 to Christian is particularly pertinent to the present invention in that it is designed to automatically pack produce such as celery stalks received from a sizing apparatus into containers. According to the latter patent, celery stalks falling within a preselected size range are ejected from a conveyor and assembled within an accumulator for gravitational transfer to an underlying container, the celery stalks assembled and dropped into the container forming one layer of stalks having the same orientation. The container is then rotated 180° in order to receive another layer of celery stalks orientated in the opposite direction. This procedure is repeated until the container is fully loaded with a preselected number of layers of produce. A rather complex mechanical arrangement is disclosed in the Christian patent for automatically effecting operation of the machine in accordance with the foregoing packing method.

The prior art as exemplified by the Christian patent aforementioned, is unsuitable for the handling of objects such as poultry and is incapable of filling containers so as to more closely approximate the minimum desired weight. Further, machines constructed in accordance with the teachings in the Christian patent would be too complex from a mechanical standpoint so as to function reliably for any extended period of time within the environment of a poultry processing plant. It is therefore an additional object of the present invention to provide an automatic container filling machine which is particularly suitable for operation within a poultry processing plant and in synchronized operational relationship to existing weight sorting apparatus.

SUMMARY OF THE INVENTION

In accordance with the present invention, birds ordinarily collected in a weight sorting bin associated with a weight sizing drip line in a poultry processing plant, are received in an inlet chute and gravitationally guided into a receiver from which each bird is displaced by movement of a ram through a fixed stroke into an accumulator section. A preselected number of birds are so compacted into a storage zone formed in the accumulator section before the birds are gravitationally transferred or dropped into a portion of an underlying container supported on a turntable assembly. The selected number of birds stored in the accumulator section are dropped by retraction of movable release doors positioned over one half of the container. Following each drop or transfer of birds into an underlying container, the container is reorientated by rotation of the turntable assembly through a 180° arc of travel in order to position the other half portion of the container in alignment with the accumulator section in order to receive another row of birds. In this fashion, two rows of birds with their legs toward the center, are transferred to the container in order to form a single layer therein. The foregoing procedure is repeated until a preselected number of layers are deposited into the container. At that point, an additional number of birds less than the number in each row, are accumulated in the accumulator section and dropped into the container in order to complete the filling thereof. When filling of the container is completed, the loaded container is automatically displaced from the turntable assembly by an empty container fed to the turntable assembly by a container feeding mechanism. The foregoing automatic operation of the container filling machine is controlled by logic components of the fluidic type in one embodiment of the invention. The logic components feedback signals from sensors associated with the weight sorting apparatus and the container filling machine itself in order to provide command signals to fluid power operated control mechanism operating a ram for displacing birds into the accumulator section, retracting doors of the accumulator section to drop birds into the container, rotating the turntable assembly to reorientate the container and for operating the feeding apparatus to displace a filled container from the turntable assembly and replace it with an empty container.

The control logic includes two binary counter devices for respectively preselecting the number of birds in each row forming the layers deposited into the container and the number of rows or layers transferred to the container. One of the counter devices also controls the supplemental number of birds dropped into the container on top of the final layer to complete the filling of the container. Sensors detecting the release of birds from carriers conveyed through the weight sorting apparatus and movement of the emptied carriers downstream from the release station, produce signal pulses that trigger operation of the ram and are counted by one of the counter devices. The other counter device counts the signal pulses produced by operation of the drop release doors of the accumulator section. The output signals of the counter devices are processed by control logic components to generate the command signals for timely operation of the doors of the accumulator section, rotation of the turntable assembly and operation of the container feed mechanism.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING FIGURES

FIG. 1 is a side elevation view of a container filling machine constructed in accordance with the present invention and shown in association with a poultry weight sorting apparatus as viewed in transverse section.

FIG. 4 is a perspective view of a container filled with poultry by the machine.

FIG. 5 is an enlarged partial section view taken substantially through a plane indicated by section line 5—5 in FIG. 1.

FIG. 7 is an enlarged partial section view taken substantially through a plane indicated by section line 7—7 in FIG. 6.

FIG. 15 is an enlarged partial section view taken substantially through a plane indicated by section line 15—15 in FIG. 13.

FIG. 20 is a partial side elevation view as seen from a plane indicated by section line 20—20 in FIG. 16.

FIG. 22 is a block diagram depicting the control system associated with the present invention.

DETAILED DESCRIPTION OF PREFERRED EMBODIMENT

General Arrangement Of Apparatus

Figure 2:
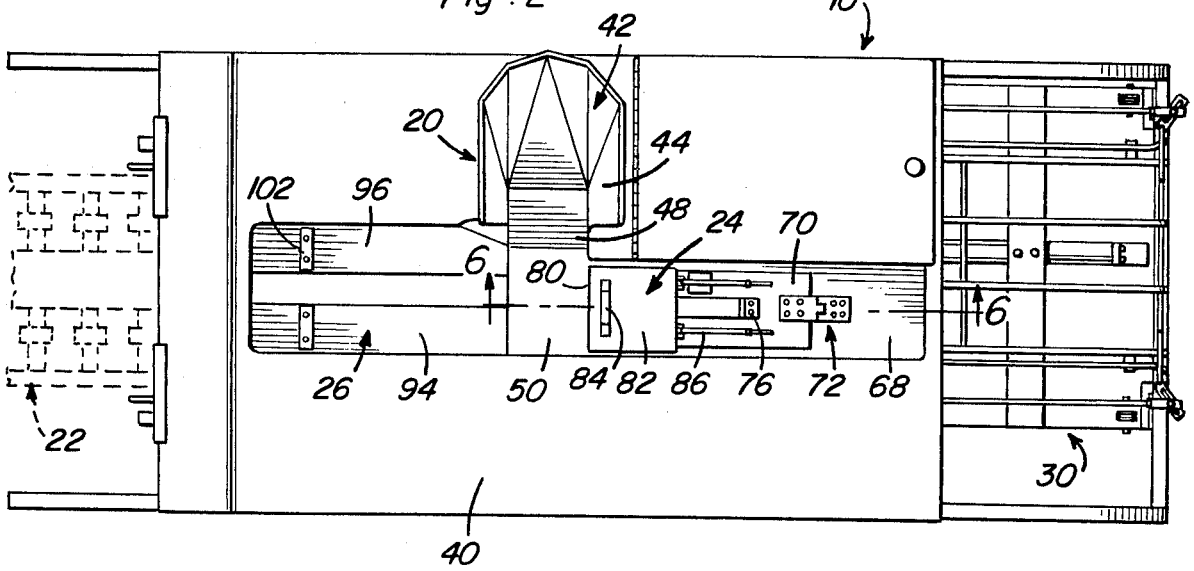
FIG. 2 is a top plan view of the machine shown in FIG. 1.
Figure 3:
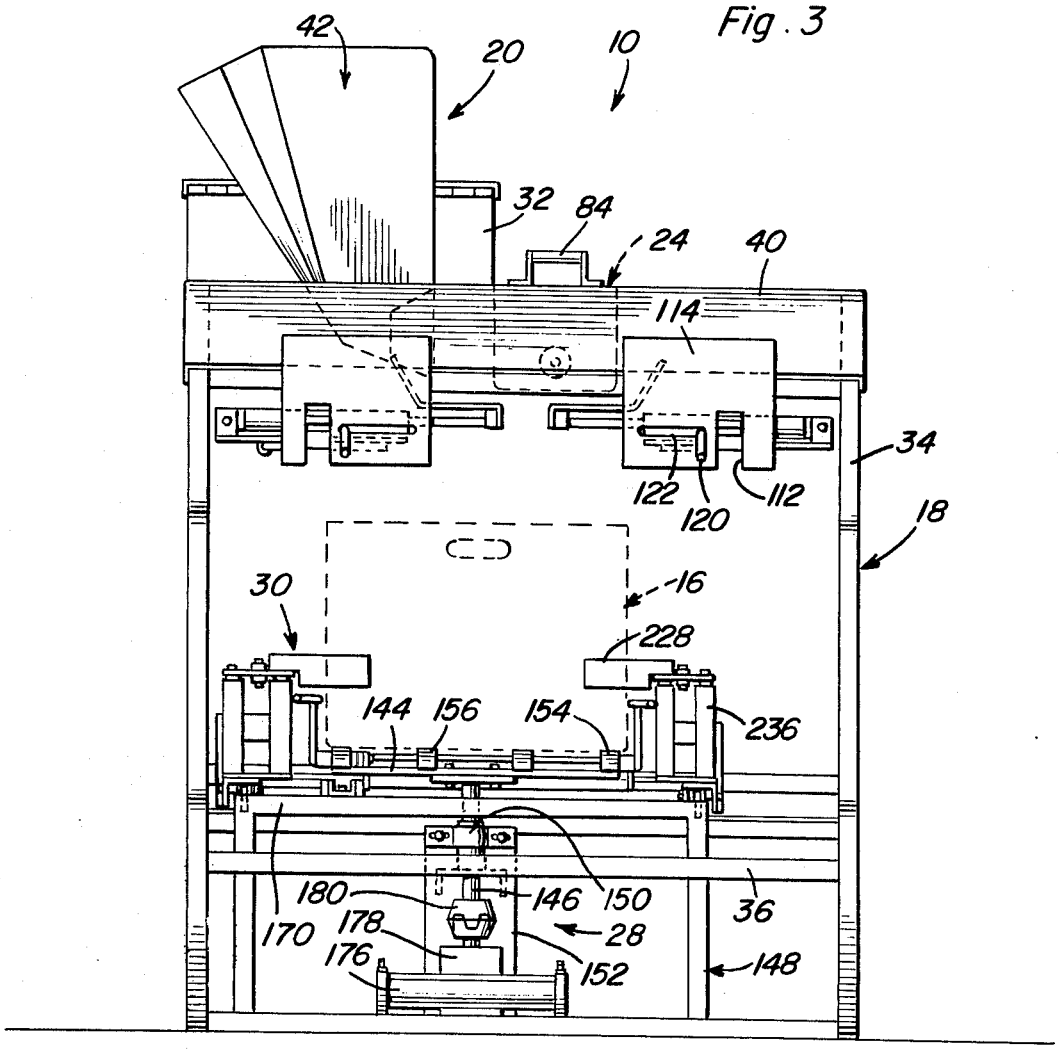
FIG. 3 is a front elevation view of the machine shown in FIGS. 1 and 2.

Referring now to the drawings in detail, FIGS. 1, 2 and 3 illustrate a container filling or packing machine constructed in accordance with the present invention and generally denoted by reference numeral 10. The container filling machine is operationally located relative to and interrelated operationally with a poultry weight sorting assembly 12 of any suitable type such as those disclosed for example in U.S. Pat. Nos. 3,124,831, 3,132,373, 3,291,303, 3,642,130, 3,643,790 and 3,680,693. Briefly, the weight sorting assembly 12 is operative to effect the gravitational release of birds 14 within a predetermined weight range, said birds being packed into a paper board container 16 as shown in FIG. 4 within the container filling machine 10 from which the filled container is delivered to stations at which the container is iced and closed and made ready for shipment.

With continued reference to FIGS. 1, 2 and 3, the container filling machine 10 is supported on the floor by its frame assembly generally referred to by reference numeral 18 in operative underlying relation to a discharge station of the weight sorting assembly 12 in order to accept birds 14 within a receiver generally referred to by reference numeral 20. The receiver is located intermediate opposite ends of the frame assembly 18 which extends longitudinally in transverse relation to the direction of travel of the birds through the weight sorting assembly 12. Cardboard containers 16 are fed to the machine 12 from a suitable source (not shown) entering the machine at the right-hand end of the frame assembly as viewed in FIG. 1, the filled containers exiting from the machine at the left-hand end by means of a roller type of gravity conveyor 22 as shown by dotted line in FIGS. 1 and 2.

As will be explained in greater detail hereafter, the birds are displaced from the receiver 20 by means of a ram assembly 24 into an accumulator section generally referred to by reference numeral 26. A predetermined number of birds are stored within the accumulator section and then dropped onto an underlying turntable mechanism generally referred to by reference numeral 28 in which a container is supported. Empty containers are fed to the turntable and filled containers are displaced from the turntable onto the delivery conveyor 22 by means of a container feeding mechanism generally referred to by reference numeral 30. A control box 32 mounted by the frame assembly 18 rearwardly of the receiver 20 along the longitudinal axis of the frame assembly 18, houses control logic components through which automatic operation of the container filling machine 10 is governed.

The frame assembly 18 includes a pair of parallel spaced, enclosed side frame assemblies 34 made of a cross-sectionally tubular material such as aluminum. The side frames 34 are interconnected by cross frame members 36 and are braced intermediate the opposite longitudinal ends thereof by vertical frame posts 38. Also bridging the side frames 34 and extending longitudinally along the frame assembly a substantial distance intermediate opposite ends, is a top surface 40 formed by a smooth piece of sheet aluminum from which the receiver 20 projects upwardly. The top sheet material 40 forms a protective surface for the mechanisms located therebelow and is supported by the frame assembly between the side frames 34.

Receiver

As more clearly seen in FIG. 5, the receiver 20 includes an inlet chute 42 formed from sheet material having upwardly extending side wall portions 44 interconnected by an upwardly inclined back wall portion 46. The side wall and back wall portion of the inlet chute 42 converge downwardly below the upper surface of the top 40 and are interconnected by a downwardly inclined throat portion 48 to a horizontal receiver portion 50 spaced below the top sheet 40 and connected thereto by a stop wall portion 52 at right angles to the receiver floor portion 50.

The stop wall portion 52 of the receiver 20 will position a bird 14 directed onto the receiver floor portion 50 by the inlet chute 42, in front of the ram mechanism 24 as more clearly seen in FIG. 2. The receiver 20 is accordingly disposed intermediate the ram mechanism 24 and the accumulator section 26. Further, the receiver 20 extends laterally of the accumulator section so that its inlet chute portion 42 will underlie the bird releasing station of the weight sorting assembly 12. As more clearly seen in FIGS. 1 and 5, the birds 14 are dropped into the inlet chute 42 at the discharge station of the weight sorting assembly from a releasable poultry carrying shackle 54 of the type disclosed in U.S. Pat. No. 3,132,373. The poultry carrying shackles are continuously conveyed along the weight sorting assembly by an overhead conveyor 56 as more clearly seen in FIG. 5 to which the shackles are connected. While being conveyed through the weight sorting assembly, the poultry carrying shackles are rollingly supported on fixed tracks 58. At the weighing station, a gap in the fixed tracks is occupied by a vertically movable track section through which the loaded shackles are weighed. If the weight of the loaded shackles is within a predetermined weight range, a latch element 60 associated with the shackle is displaced upwardly by a power operated trip release mechanism 62 to thereby permit release of the bird under the urge of gravity. Operation of the latch releasing trip mechanism 62 is detected by a fluidic sensor as will be explained hereafter in order to provide a control signal to fluidic logic located within the control box 32. A pair of spaced fluidic sensors 64 and 66 as shown in FIG. 5 are also mounted on the fixed track just downstream of the poultry discharge station in order to provide additional signals to the control logic indicating the presence of the moving shackle 60. In the illustrated embodiment, the signals from the sensors 64 and 66 are established when the shackle interrupts a jet of air that is normally provided at the sensor locations spanning the fixed track sections 58 between which the poultry shackles travel. Because of the time it takes for the shackles to travel from the discharge station to the locations of the sensors 64 and 66, a synchronized delay is introduced into the automatic operation of the container filling machine as will be explained hereafter.

Ram Mechanism

Figure 6:
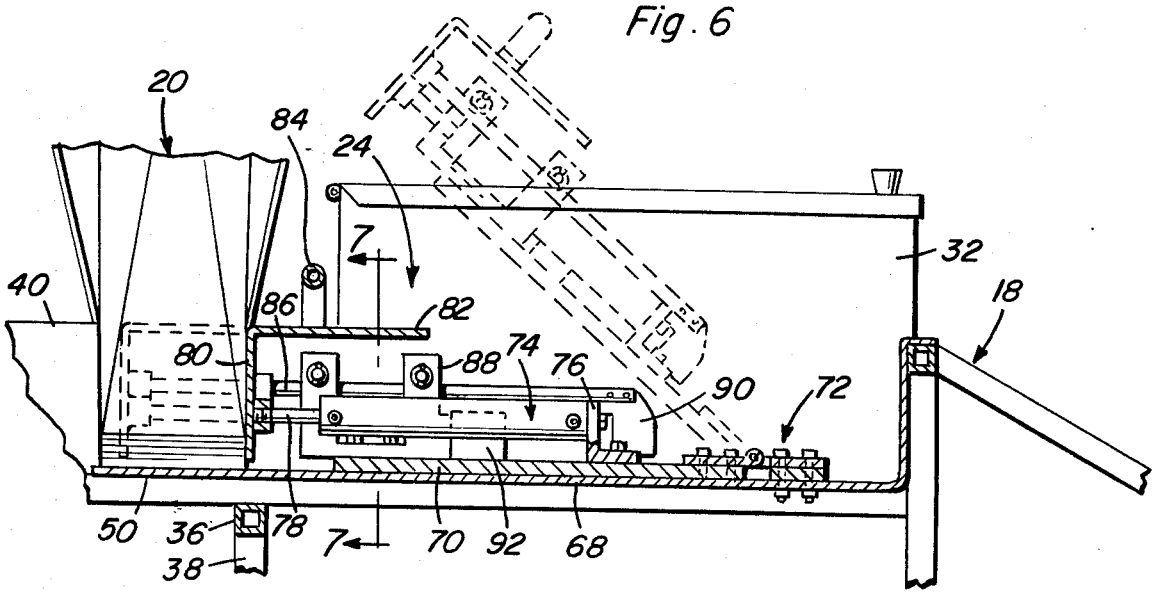
FIG. 6 is an enlarged partial section view taken substantially through a plane indicated by section line 6—6 in FIG. 5.

As more clearly seen in FIG. 6, the ram assembly 24 is supported on a rearwardly extending extension 68 of the horizontal receiver floor portion 50 anchored to the frame assembly and forming the bottom of a well formed in the top surface 40. The floor extension 68 supports a mounting plate 70 that is pivotally secured by a hinge 72 to the floor extension. A fluid power control devices in the form of an air cylinder 74 is anchored at one of its axial ends to the mounting plate 70 by an anchor element 76 as more clearly seen in FIG. 6. The other end of the air cylinder device 74 has a piston rod 78 extending therefrom, the forward end of the piston rod being connected to a ram plate 80 forming an impact face at right angles to the floor extension 68. The ram plate 80 is displaced by the piston rod forwardly through the receiver chamber defined above the horizontal floor portion 50 of the receiver. A protective top plate 82 extends rearwardly at right angles to the ram plate 80. A handle 84 is connected to the top plate 82 by means of which the entire ram assembly may be lifted upwardly about the hinge axis associated with hinge 72 as shown by dotted line FIG. 6. This arrangement facilitates cleaning of the machine in the vicinity of the ram assembly. As more clearly seen in FIG. 7, a pair of parallel spaced guide rods 86 are connected to the ram plate 80 on either side of the piston rod 78 and extend rearwardly therefrom through longitudinally spaced roller guide assemblies 88 which are secured to the mounting plate 70. A more rigid arrangement is thus formed capable of imparting the requisite impact to the bird as the ram plate 80 is displaced by the air cylinder device 74 through a fixed stroke as shown by dotted line in FIG. 6. Connected to the rear end of one of the guide rods 86, is a flag element 90 adapted to be received within a fluidic sensor 92 fixedly mounted on the mounting plate 70 on the rear side of one of the roller guide assemblies 88. Thus, each time the ram executes a stroke, a signal is produced by the sensor 92 and fed to the fluidic control logic.

Accumulator Section

Figure 10:
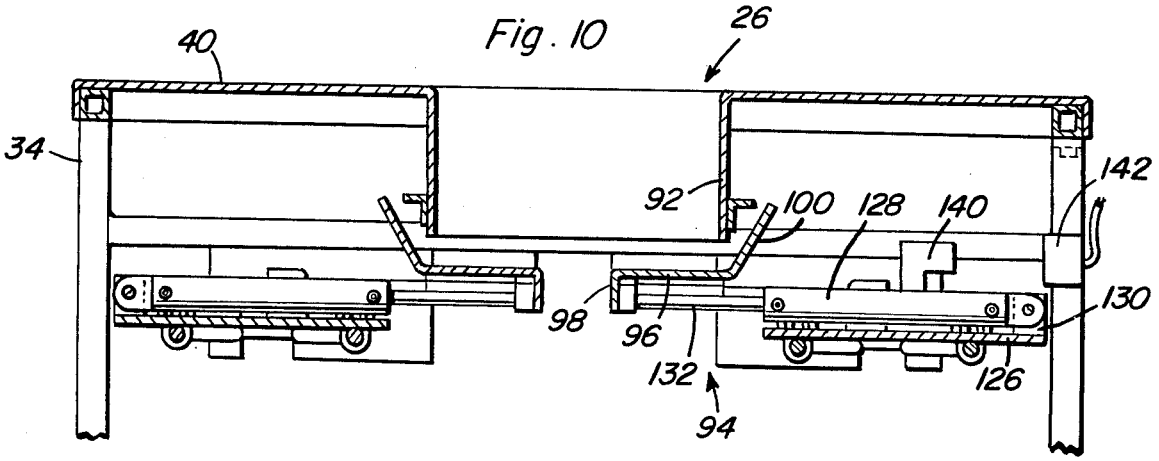
FIG. 10 is an enlarged partial section view taken substantially through a plane indicated by section line 10—10 in FIG. 1.
Figure 8:
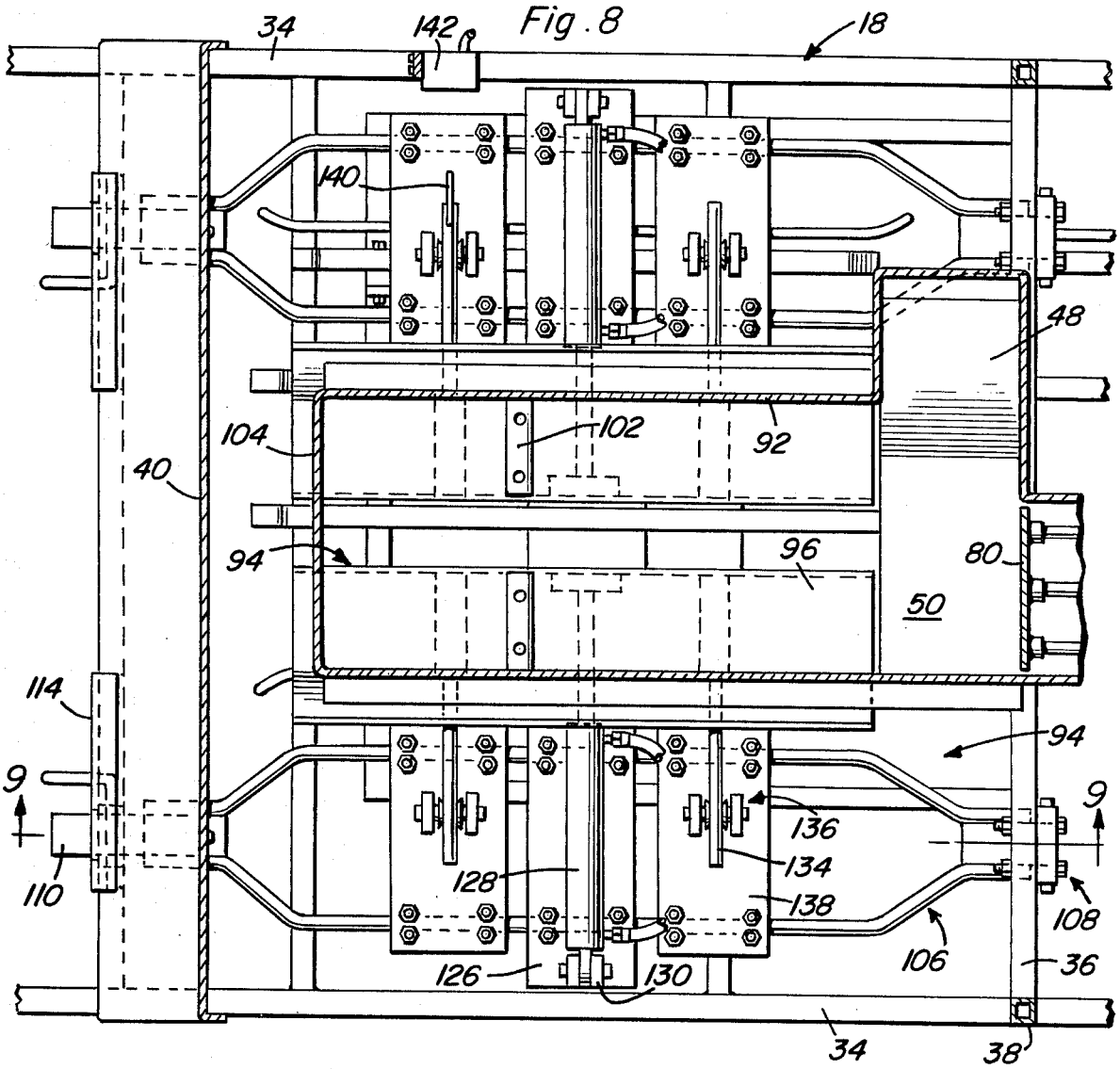
FIG. 8 is an enlarged partial section view taken substantially through a plane indicated by section line 8—8 in FIG. 1.
Figure 9:
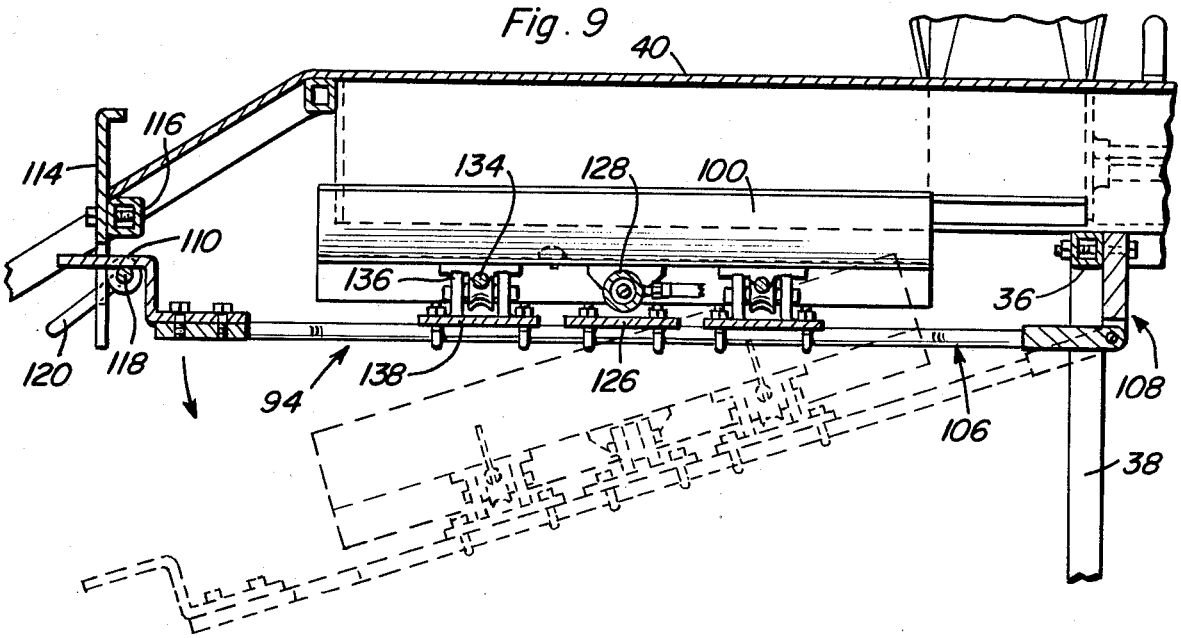
FIG. 9 is a partial section view taken substantially through a plane indicated by section line 9—9 in FIG. 8.

With reference to FIGS. 1, 2 and 10, the accumulator section 26 includes an elongated opening formed in the top 40 between parallel spaced, depending side walls 92. The opening extends in alignment with the receiver chamber of the receiver 20. Birds displaced into the accumulator section by the ram mechanism 24 would ordinarily drop through the opening if not for a pair of door assemblies 94 closely below the side walls 92. Each door assembly is provided with a horizontal door portion 96, a downturned, confronting flange portion 98 and an upwardly inclined portion 100. In the closed positions of the doors as shown in FIGS. 2 and 10, the confronting flange portions 98 are spaced from each other by a gap too small to permit any birds to drop through. Each horizontal portion 96 has a bar 102 secured thereto closer to the longitudinal end opposite the receiver 20 as more clearly seen in FIG. 2. These bars function to decelerate movement of birds that are displaced into the accumulator section by the ram assembly. Thus, the first bird to be received within the accumulator comes to rest against the forward end wall 104 as more clearly seen in FIG. 8 spanning the gap between the closed door assemblies 94. The decelerating effect of the bars 102 on the birds prevents any excessive and undesirable reorientation of the birds so that they may be compacted in an orderly arrangement within the accumulator section under the inpact force of the ram assembly.

Figure 12:
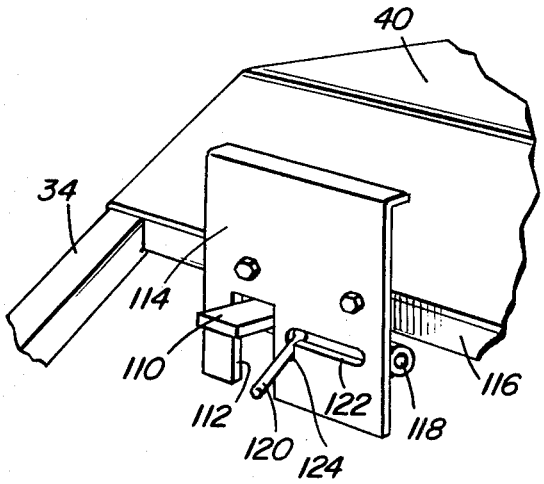
FIG. 12 is a partial perspective view of one of the releasable latch devices associated with the machine shown in FIGS. 1, 2 and 3.

As more clearly seen in FIGS. 8, 9, 10 and 11, each door assembly 94 is mounted in operative position by means of an elongated subframe generally referred to by reference numeral 106 that is pivotally connected to the cross frame member 36 by means of a hinge assembly 108. Each subframe assembly 106 has a latch bar 110 secured to the forward end thereof. The latch bar is received within a slot 112 formed in a latch plate 114 secured to a cross frame member 116 as more clearly seen in FIG. 12. A latch pin 118 is slidably supported on the latch plate and has a control arm 120 extending through a horizontal slot 122 in the latch plate. A lock notch 124 is formed at one end of the slot 122 for receiving the control arm 120 and holding the latch pin 118 extended below the latch bar 110 in order to hold the subframe assembly 106 in its operative horizontal position as shown by solid line in FIG. 9. By raising the control arm 120 and slidably withdrawing the latch pin 118, the subframe assembly 106 may be released in order to permit the entire door assembly 94 to swing downwardly as shown by dotted line in FIG. 9. In this fashion, the area of the machine in the vicinity of the door assembly may be readily cleaned.

Figure 11:
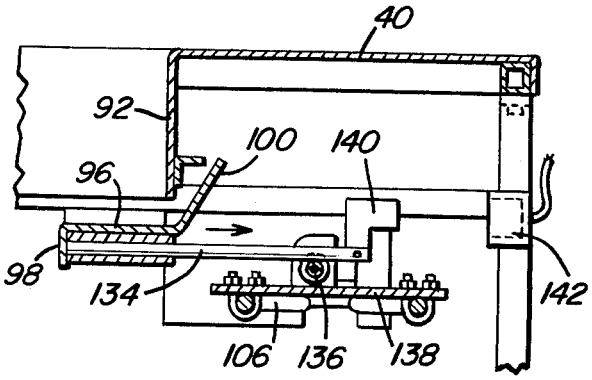
FIG. 11 is an enlarged partial section view taken substantially through a plane indicated by section line 11—11 in FIG. 1.

Each subframe assembly has mounted thereon, a mounting plate 126 on which a power control device in the form of an air cylinder 128 is carried. A pivotal anchor 130 secures one axial end of the air cylinder device 128 to the mounting plate, the other axial end of the air cylinder device having a piston rod 132 extending therefrom, the piston rod being connected to the confronting flange portion 98 of the door as more clearly seen in FIG. 10. Suitable fluid hose connections are provided for the air cylinder device in order to effect retraction of the door. Movement of the door is guided by a pair of guide rods 134 secured to the confronting flange portion 98 on either side of the piston rod 132. The guide rod 134 extend rearwardly from the doors and through roller guide assemblies 136 secured to mounting plates 138 carried on the subframe assembly 106 on either side of the mounting plate 126. Connected to the end of one of the guide rods 134 as more clearly seen in FIG. 11, is a flag element 140 adapted to be received within a fluidic sensor 142 whenever the door is retracted. Both door assemblies are simultaneously retracted in order to drop a predetermined number of birds accumulated within the accumulator section and each of such transfers of accumulated birds produces a signal in sensor 142 fed to the fluidic control logic.

Turntable Mechanism

Figure 13:
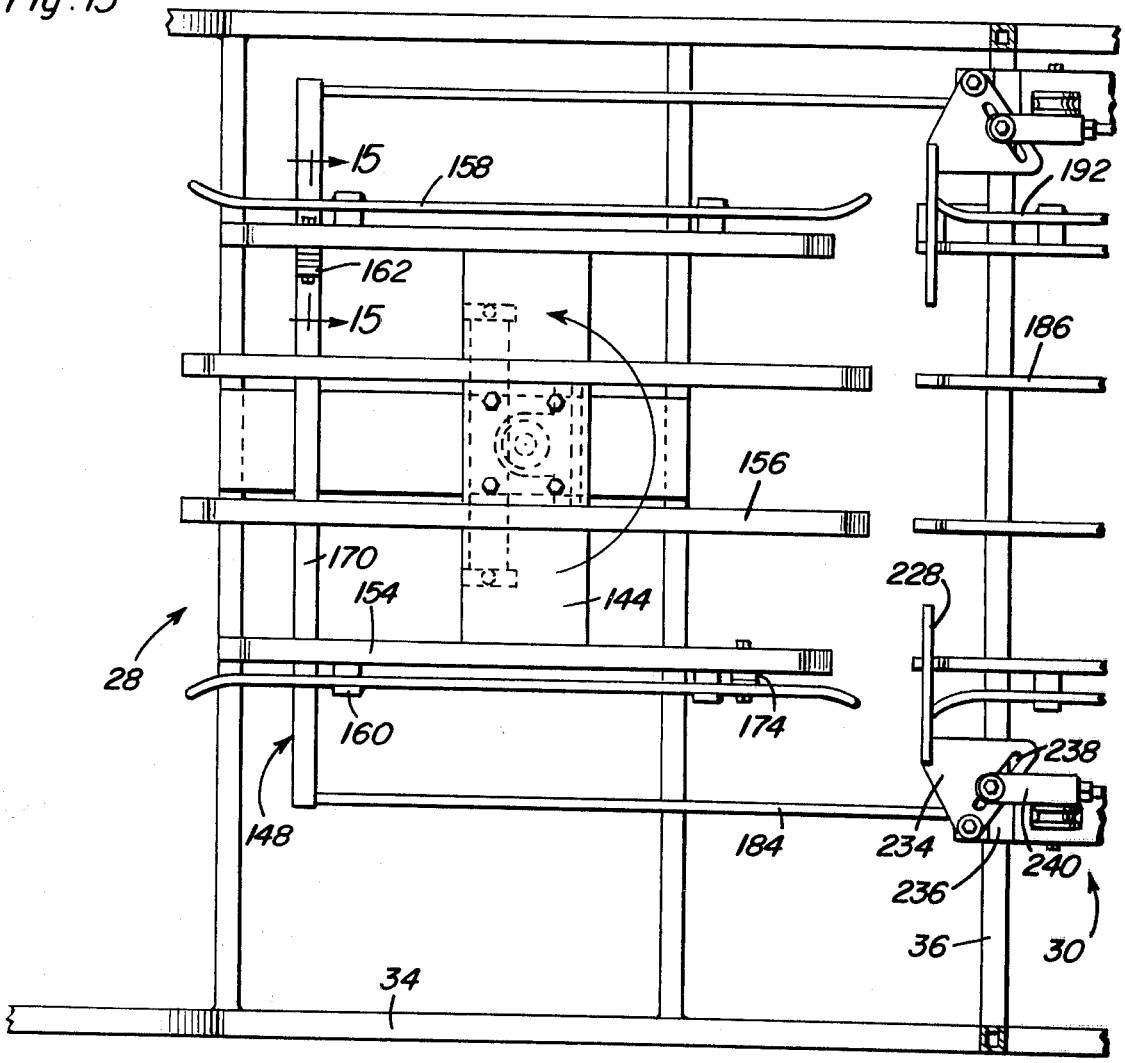
FIG. 13 is an enlarged partial section view taken substantially through a plane indicated by section line 13—13 in FIG. 1.
Figure 14:
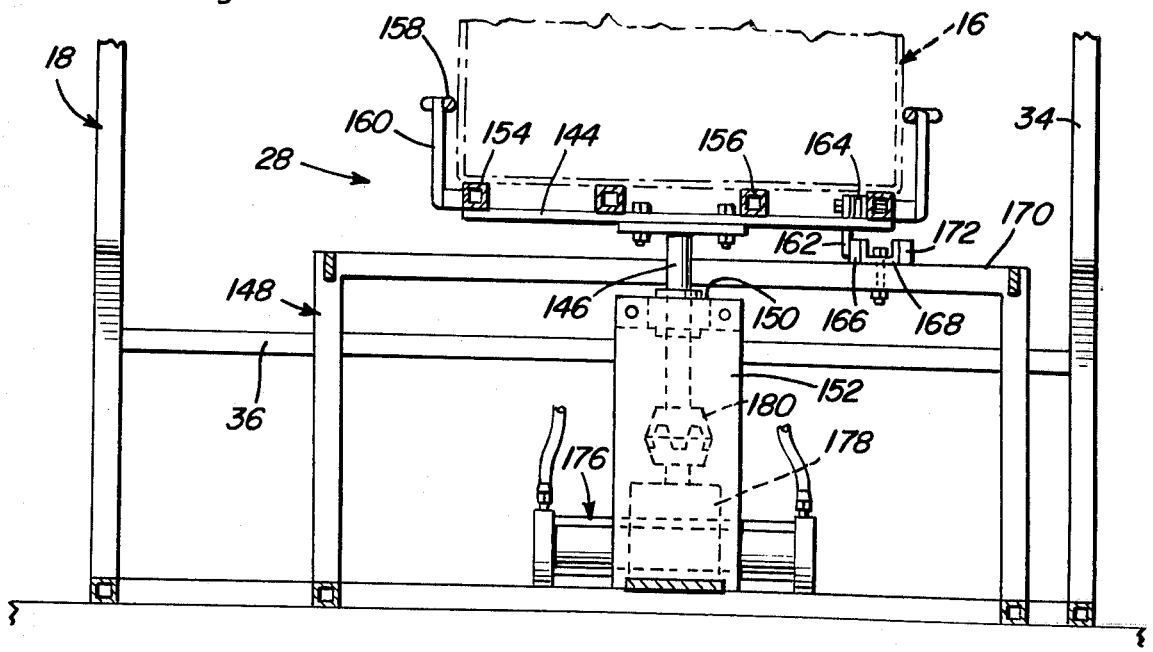
FIG. 14 is an enlarged partial section view taken substantially through a plane indicated by section line 14—14 in FIG. 1.

Each time a predetermined number of birds stored in the accumulator section, are dropped by retraction of the door assemblies 94, the dropped birds are received within a container 16 supported on the turntable assembly 28 which is accordingly positioned below the opening formed between the side walls 92 and end wall 104 of the accumulator section. While the turntable is aligned with this opening in a longitudinal direction, relative to the frame assembly, it is laterally offset with respect to the accumulator opening so that only half of the container 16 underlies the opening defined between the side walls 92 and end wall 104. The turntable assembly as more clearly seen in FIGS. 13 and 14, includes a transversely extending base plate 144 centrally secured to the upper end of a rotor shaft 146 that extends above a subframe assembly 148 fixed to the main frame assembly 18. The rotor shaft is rotatably mounted for rotation about a vertical axis by a bearing assembly 150 secured to the upper end of a vertical mounting plate 152. Parallel spaced end bars 154 are secured to the ends of the base plate 144 while a pair of parallel spaced skid bars 156 are secured to the base plate intermediate the ends. The end bars 154 and skid bars 156 define a horizontal support surface on which the container 16 rests between fence elements 158 connected to the end bars by fence posts 160. As more clearly seen in FIGS. 13 and 15, a stop element 162 is secured to one of the end bars 154 and spaced therefrom by shims 164 on one side for abutment with a resilient bumper 166 carried by a position limiting member 168 which is secured to the cross frame member 170 of the subframe assembly 148. Thus, the stop element 162 engages the bumper 166 in the position of the turntable assembly shown in FIG. 13. When the turntable is rotated 180 degrees in a counterclockwise direction as viewed in FIG. 13, the bumper 172 on the other side of the member 168 will be engaged by a stop element 174 secured to the other end bar 154 on a side and adjacent to an end opposite the side and end at which the stop element 162 is secured to its end bar 154.

The turntable assembly is angularly displaced by 180 degrees between the two limit positions aforementioned by an air powered cylinder control device 176 fixed to the frame assembly adjacent the lower end of the vertical mounting plate 152. The air cylinder device 176 having a reciprocating piston, is drivingly coupled to the rotor shaft 146 through a commercially available type of drive mechanism 178 by means of which reciprocating movement is converted into oscillating movement, the output of the drive mechanism 178 being connected to the rotor shaft 146 through a coupling 180.

CONTAINER FEEDING MECHANISM

Empty containers are pushed onto the turntable assembly 28 from the feeding mechanism 30 which is mounted by the frame assembly 18 underlying the ram assembly 24 and in alignment with the turntable assembly. Accordingly, the feeding mechanism extends longitudinally between the cross frame members 36 and 182 interconnecting the side frames 34 of the frame assembly as more clearly seen in FIG. 16. Also, it will be observed that the feeding mechanism is laterally displaced from the longitudinal axis of the frame assembly so as to be closer to one of the side frames 34 in operative alignment with the turntable assembly 28. In this fashion, the containers are delivered to the turntable so that half of the container will directly underlie the elongated opening in the accumulator section 26 in order to accommodate transfer of a predetermined number of birds to one side of the container after which the other side is positioned below the accumulator opening by rotation of the turntable assembly 28 through 180° travel.

Associated with the feeding mechanism, are a pair of parallel spaced track bars 184 that are connected to and supported on the cross frame members 36 and 182 and extend forwardly therefrom to the frame member 170 associated with the subframe assembly 148 supporting the turntable assembly. Also fixed to the frame assembly, are a plurality of fixed skid bars 186. The skid bars are interconnected with each other in parallel spaced relationship by a plurality of longitudinally spaced connecting bars 188, the rear ends of the skid bars being connected to the rear end portion of the frame assembly. The forward ends of the outermost skid bars 186 are connected by brackets 190 to the cross frame member 182 as more clearly seen in FIG. 17. The containers 16 as shown by dotted line in FIGS. 17 and 18, are slidably supported on the skid bars 186 between fence elements 192 that are connected to and vertically spaced above the outer skid bars by post members 194.

Figure 16:
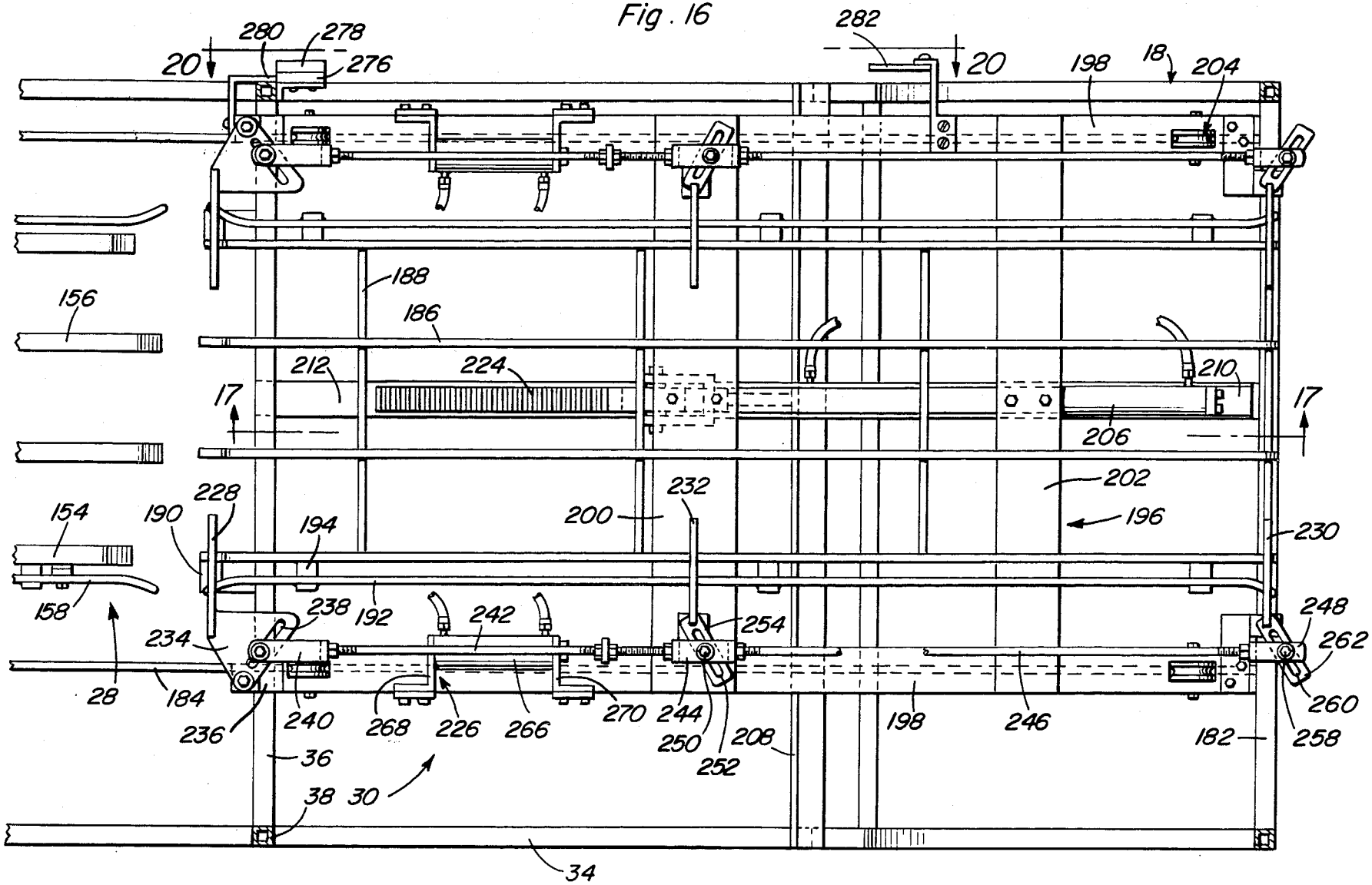
FIG. 16 is an enlarged partial section view taken substantially through a plane indicated by section line 16—16 in FIG. 1.

A movable carriage assembly generally referred to by reference numeral 196, is slidably mounted on the track bars 184 in underlying relationship to the skid bars 186 in order to effect displacement of the containers 16 along the skid bars. With reference to FIGS. 16, 17 and 18, the carriage assembly 196 includes a pair of parallel spaced carriage frame members 198 made of right angle sections, the frame members being interconnected by longitudinally spaced plate members 200 and 202. Mounted by the frame members 198 adjacent the forward and rear ends thereof, are roller assemblies 204 by means of which the carriage assembly may be guided for reciprocating movement from the retracted position shown in FIGS. 16 and 17 to an extended position overlying the skid bars 156 and end bars 154 associated with the turntable assembly 28 in order to effect transfer of an empty container to the turntable assembly while pushing a loaded container from the turntable assembly onto the delivery conveyor. The upper supporting surfaces of the fixed skid bars 186 and the skid bars 156 and end bars 154 associated with the turntable assembly, define a common plane for smooth transfer of the containers from the feeding mechanism to the turntable assembly in response to movement of the carriage assembly from the retracted position to the extended position.

Movement of the carriage assembly 196 is effected by a fluid power control device in the form of an air cylinder device 206 fixed to the frame assembly. The forward axial end of the air cylinder device 206 is anchored to the frame assembly by means of a right angle frame member 208 which is interconnected between the side frames 34 of the frame assembly as more clearly seen in FIGS. 16 and 17, the rear axial end of the air cylinder device 206 being anchored to the frame assembly by a bracket 210 which is secured to the rear end of a right angle frame member 212 that extends longitudinally of the feeding mechanism. The frame member 212 is fixedly interconnected at its forward and rear ends to the cross frame member 36 and the bracket 210 disposed thereabove as more clearly seen in FIG. 17. Movement is transmitted to the carriage assembly by means of the piston rod 214 extending forwardly from the air cylinder device 206 and a rack and pinion drive mechanism generally referred to by reference numeral 216.

Figure 17:
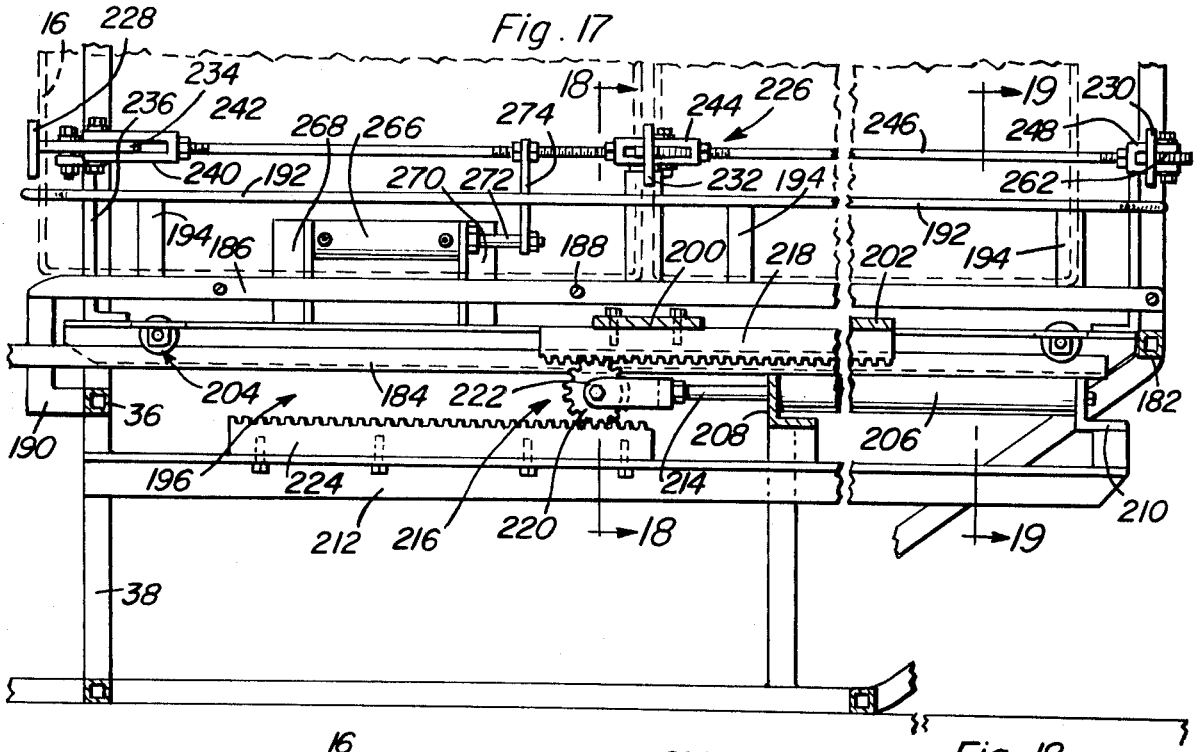
FIG. 17 is a partial transverse section view taken substantially through a plane indicated by section line 17—17 in FIG. 16.
Figure 18:
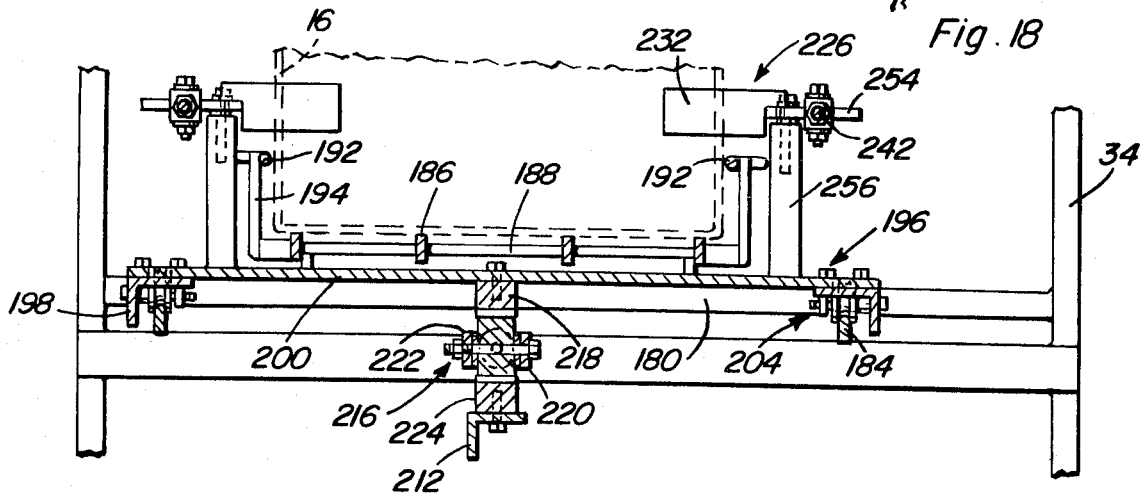
FIG. 18 is a partial transverse section view taken substantially through a plane indicated by section line 18—18 in FIG. 17.

As more clearly seen in FIGS. 17 and 18, the rack and pinion drive mechanism includes a rack member 218 that is interconnected with the plate members 200 and 202 of the carriage assembly and disposed just above the air cylinder device 206. A pinion gear 220 is rotatably supported by a clevis element 222 secured to the forward end of a piston rod 214 for meshing engagement with the depending teeth of the rack member 218 and the upwardly projecting teeth of a fixed rack member 224 secured to the longitudinally extending frame member 212. The drive ratio of the rack and pinion drive 216 is such that the carriage assembly will move from its retracted position spaced from the turntable assembly to an extended position completely overlying the turntable assembly a distance greater than the shorter distance of the piston stroke associated with the air cylinder device 206.

Figure 19:
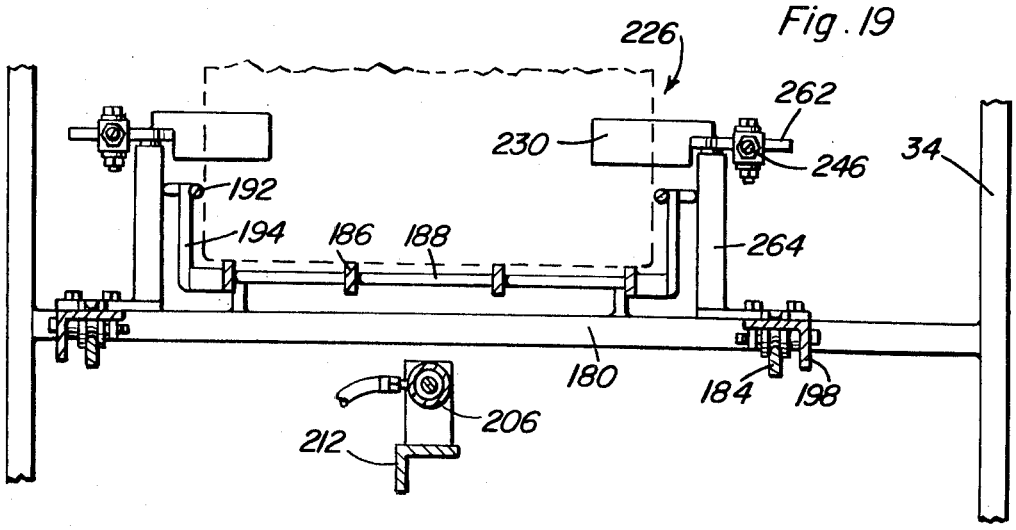
FIG. 19 is a partial transverse section view taken substantially through a plane indicates by section line 19—19 in FIG. 17.

Containers are displaced with the carriage assembly during movement in one direction from the retracted position to the extended position under control of a container engaging feed control mechanism generally referred to by reference numeral 226 carried on the carriage assembly. The feed control mechanism includes a pair of container engaging arms 228 that extend toward each other adjacent the forward end of the carriage assembly as more clearly seen in FIG. 16, a pair of container engaging arms 230 extending toward each other adjacent the rear end of the carriage assembly and a pair of intermediate arms 232 overlying the plate member 200 of the carriage assembly. Each of the front arms 228 extends from a lever arm 234 pivotally mounted by a bracket 236 at the forward end of the carriage frame member 198. The lever arm 234 is provided with a slot 238 slidably receiving a pin associated with a clevis element 240 connected to the forward end of a tie rod 242. The tie rod 242 is in turn interconnected by a turnbuckle device 244 to a second tie rod 246, the rear end of which is connected to a clevis element 248. The turnbuckle device 244 mounts a pin 250 slidably received in a slot 252 formed in a lever element 254 mounting the arm 234 and is rotatably mounted on the carriage plate member 200 by a pivot post 256 as more clearly seen in FIG. 18. The rear clevis element 248 on the other hand is provided with a pin 258 slidably received within a slot 260 as shown in FIG. 16 formed in a lever element 262 from which the rear container engaging arm 230 extends. The lever element 262 is pivotally mounted at the rear end of the carriage frame member 198 by means of a post 264 as more clearly seen in FIG. 19. Thus, it will be apparent that all three of the container engaging arms 228, 230 and 232 on each longitudinal side of the carriage assembly, will be simultaneously displaced by virtue of the linkage connections established by the interconnected tie rods 242 and 246 and the slotted lever elements 234, 254 and 262. It will also be apparent however, that the container engaging arms 228 will be pivotally displaced in a direction opposite to the direction in which the other two arms 230 and 232 are pivotally displaced at the same time. Displacement of the container engaging arms on each longitudinal side of the carriage assembly is effected by a fluid power control device in the form of an air cylinder device 266. As more clearly seen in FIGS. 16 and 17, opposite ends of the air cylinder device 266 are anchored to the carriage frame member 198 by anchor brackets 268 and 270. The rearwardly extending piston rod 272 associated with the air cylinder device 266 is connected by a connecting bar 274 to the tie rod 242 at an adjusted position.

As will be explained hereinafter, both of the air cylinder devices 266 respectively disposed on opposite longitudinal sides of the carriage assembly, are simultaneously operated in order to effect displacement of the container engaging arms. With the arms extending perpendicular to the longitudinal axis or direction of travel of the carriage assembly, as shown in FIG. 16, containers positioned between the front arms 228 and the intermediate arms 232 and between the intermediate arms 232 and the rear arms 230, will be bodily displaced with the carriage assembly in a forward direction. Further, the front arms 228 will displace a loaded container from the turntable assembly as an empty container is displaced between the arms 228 and 232 onto the turntable assembly. At the same time, another empty container positioned between the arms 232 and 230 will be brought into position for subsequent displacement onto the turntable assembly. Once the carriage assembly with the container engaging arms has been extended to the end of its stroke, overlying the turntable assembly, both of the air cylinder devices 266 are operated in order to displace the front arms 228 in a counterclockwise direction to positions parallel to the direction of travel and out of contact with the container then positioned over the turntable assembly. At the same time, the arms 232 and 230 will be pivotally displaced in the opposite direction or rearwardly as viewed in FIG. 16 to positions parallel to the direction of travel. With all of the container engaging arms positioned parallel to the direction of travel and disposed on the outside of the fence elements 192, the carriage assembly may be retracted without inparting any rearward movement to the container previously advanced forwardly. When the carriage assembly reaches its retracted position and a new empty container is fed into the machine from some external source, the container engaging arms are again displaced 90 degrees to the projecting positions shown in FIG. 16 in preparation for the next container displacing operation.

Operation of the carriage and synchronized operation of the feed control mechanism carried thereon is controlled by signals produced by limit position detecting sensors. As shown in FIGS. 16 and 20, a pair of fluidic sensors 276 and 278 are mounted for this purpose on the post 38 of the frame assembly in operative alignment with flag elements 280 and 282 fixedly mounted on one longitudinal side of the carriage assembly by the carriage frame member 198. Thus, in the retracted position of the carriage assembly, the flag element 280 is received within the fluidic sensor 276 whereas the flag element 282 is received within the other sensor 278 in the extended position of the carriage assembly. Displacement of the container engaging arms to the container release positions wherein they are disposed parallel to the direction of travel, is detected by a fluidic sensor 284 which is fixedly mounted on the carriage frame member 298 in alignment with a flag element 286 secured to the tie rod 242 as shown in FIG. 20. Since both air cylinder devices 266 are operated simultaneously, a single sensor 284 and associated flag element 286 is required.

Control System

Figure 21:
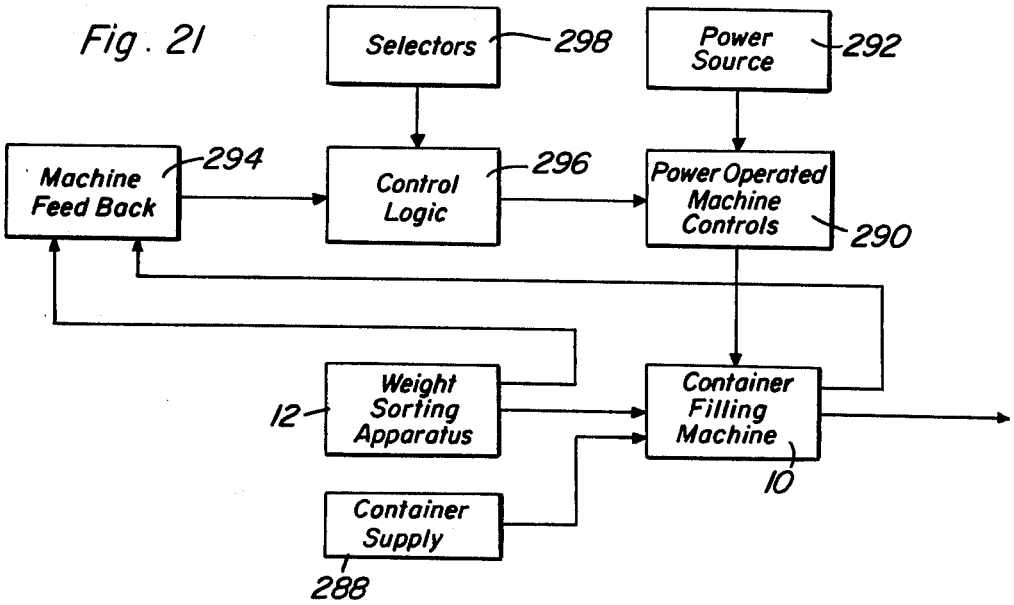
FIG. 21 is a block diagram depicting basic functional relationships of the present invention.

As diagrammatically depicted in FIG. 21, the container filling machine 10 receives objects in the form of poultry within a predetermined weight range from the weight sizing apparatus 12 and also receives empty containers from a container supply 288. Operation of the container filling machine is controlled by the various fluid power operated control devices aforementioned collectively designated by reference numeral 290 in FIG. 21. Power for operating the control devices in the form of air under pressure is derived from a suitable source 292. In order to effect automatic operation of the machine 10, signals from both the machine 10 itself and the weight sizing apparatus 12, are fed to a machine feedback component 294 forming part of the automatic control system with the control logic assembly 296 receiving input from the machine feedback component 294 and supplying commands to the power operated machine controls 290. The number of birds to be automatically loaded into a container through the machine 10 as well as the quantitative arrangement of the birds within the container may be selected through the selector component 298 connected to the control logic 296.

FIG. 22 diagrammatically outlines with greater particularity the control system including the machine feedback component 294, the control logic assembly 296 and the selector component 298. Feedback from the weight sizing apparatus 12 is obtained by detection of the release of a bird at the weighing station by means of an object release sensor 300 associated with the latch releasing mechanism 62 as aforementioned. The positions of the poultry carrier downstream of the weighing station on the other hand, are detected by the sensors 64 and 66 as aforementioned. The signals produced by the sensors 64, 66 and 300, as shown in FIG. 22, are fed to a ram control logic component 302 forming part of the control logic assembly 296 housed within the control box 32 aforementioned. Output commands from the ram control logic 302 are operative to timely operate the ram operating control device in the form of the air cylinder device 74 aforementioned. The ram assembly is thereby operative to execute a fixed stroke in order to displace poultry into the accumulator section. When the ram executes its stroke, a signal is produced by the ram position sensor 92 in order to feed a signal to an object counter component 304 within the control logic assembly. After a predetermined number of birds are counted by the counter 304, a signal is fed to the door control logic component 306 from which a command signal is fed to the door operating control devices in the form of the air cylinder devices 128 aforementioned. At the same time, signals are fed from the door control logic to a feed control logic component 308 and a turntable control logic 310. This results in a command signal being fed by the turntable control logic component to the turntable operating control mechanism in the form of the reciprocating piston device 176 resulting in the reorientation of the container in order to receive another predetermined number of birds on the other side. The foregoing cycle is repeated to thereby transfer a plurality of tiers or layers of birds into the container from the accumulator section. Each time the predetermined number of birds is dropped as determined by the count of counter 304, causing operation of the door operating mechanism 128, a signal is produced by the door retraction sensor 142, the output of which is fed to the object counter 304 and to a cycle counter component 312 through which the number of layers of birds transferred to the container, is predetermined. After a preset number of layers are transferred to the container, as counted by the cycle counter 312, a signal is fed to the reset control logic 314 in order to reset the cycle counter and terminate its counting operation. The present number of layers counted by the counter 312 is preselected through the count selector component 298 which also preselects the number of birds forming each row of the layer on each side of the container as well as a supplemental number of birds transferred to the container after reset of the cycle counter 312, as will be further explained in detail hereafter.

Feedback signals from the carriage mechanism produced by the carriage sensors 276 and 278 aforementioned are fed to the feed control mechanism 226. Feedback signals from the feed control mechanism produced by the feed control sensor 284 aforementioned are fed to the feed control logic 308. The output command signals from the feed control logic 308 controls operation of the carriage mechanism through the carriage operating control mechanism 206. An output signal from the feed control logic 308 is also fed to the turntable control logic 310 in order to obtain proper synchronization between the operation of the turntable assembly and the feeding mechanism. For the same reason, the output from the door control logic 306 controlling the transfer of birds from the accumulator section to the turntable, is fed to both the feed control logic 308 and the turntable control logic 310 in order to obtain proper synchronized operation. This synchronized operation involves angular rotation of the turntable assembly through 180 degrees following each transfer of birds to the container from the accumulator section and operation of the container feed mechanism only after the total preselected number of birds are loaded into the container.

Figure 23:
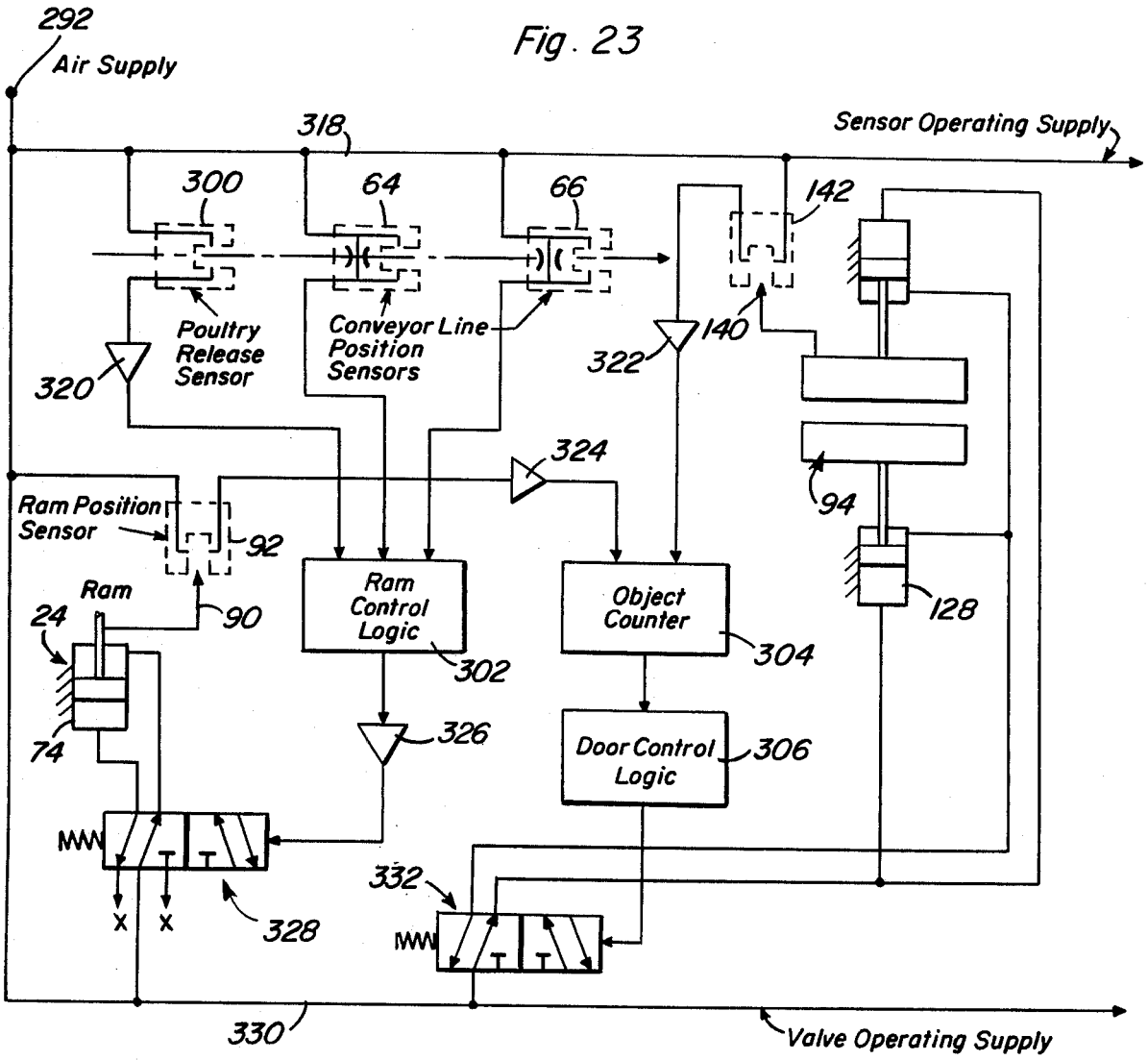
FIG. 23 is a schematic diagram illustrating the interface between certain control logics and associated sensors and power operated control devices related to delivery to and transfer from the accumulator section.

FIG. 23 diagrammatically illustrates the interface between the control logic components 302, 304 and 306 and the sensors and the power control operating devices for the ram assembly 24 and the retractable door assembly 94 associated with the accumulator section. As shown in FIG. 23, the supply of air under pressure 292 is connected to a sensor operating supply line 318 through which a fluid signal pressure medium is delivered to the sensors 300, 64, 66 and 142. The sensors 300 and 142 are of the type in which a flag element displaced into the sensor interrupts a jet of air that normally traverses a gap formed in the sensor. Fluidic control sensors of this type are well known and commercially available, such as an interruptable jet sensor manufactured by the C. A. Norgren Co. of Littleton, Colorado, designated as Model No. 4JS-010-D00. Sensors 300 and 142 of this type are connected in series with diaphragm amplifiers 320 and 322 of a type manufactured by the C. A. Norgren Co. aforementioned, designated by Model No. 5DA-011-D00. The same type of interruptible jet sensor is also utilized for the sensor 92 shown in FIG. 23 connected through a diaphragm amplifier 324 to the object counter 304. Fluidic sensors 64 and 66 are of an impacting jet type also manufactured by the C. A. Norgren Co. and designated by Model No. 4JS-020-D00. The outputs of the sensors 64 and 66, as aforementioned, are fed to the ram control logic 302. Command signals from the ram control logic 302 are amplified by a fluidic amplifier 326 and fed to the actuator of a control valve 328 by means of which air under pressure from the valve operating supply line 330, also connected to the air supply 292, may be controllably routed to the air cylinder device 74 for operating the ram assembly. A door control valve 332 similarly controls operation of the door assembly 94 through the air cylinder devices 128, actuating pressure being supplied to the door control valve 332 from the door control logic 306 to which input signals are fed from the object counter 304. As aforementioned, inputs to the object counter are received from the ram position sensor 92 and the door retraction sensor 142.

Figure 24:
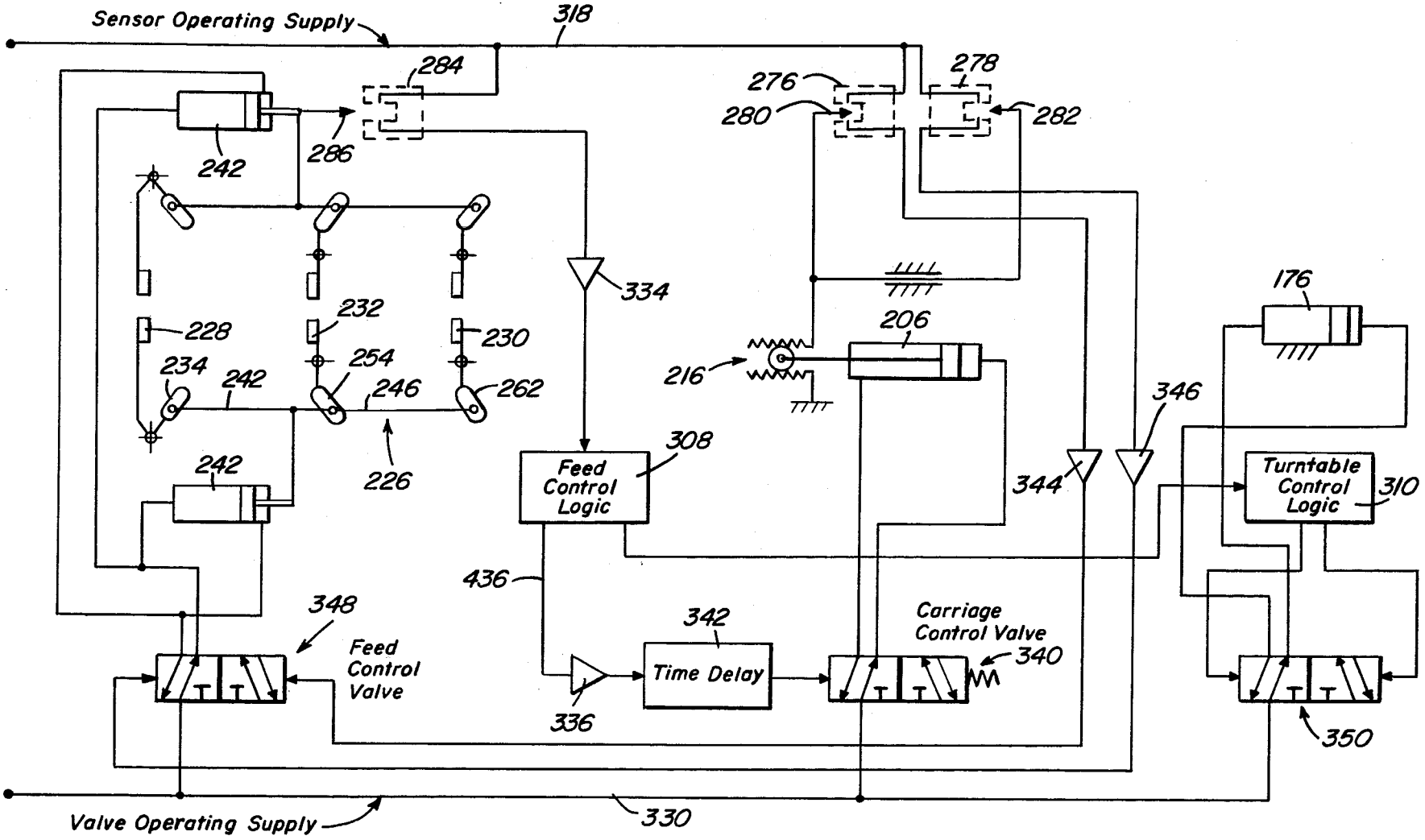
FIG. 24 is a schematic diagram illustrating the interface between other control logics and associated sensors and power operated control devices related to the movement of containers to and from the turntable assembly.

Whereas the interface illustrated in FIG. 23 automatically controls the delivery of birds to the accumulator section and transfer of birds therefrom to the turntable assembly, the feeding of containers to the turntable assembly and the reorientation of the container by the turntable assembly is controlled by the interface shown in FIG. 24 between the carriage and feed control sensors and the feed control logic 308 and turntable control logic 310 and the fluid power operating control devices for the turntable assembly and the container feed mechanism. The sensor operating supply line 318 aforementioned in connection with FIG. 23 is therefore also connected to the feed control sensor 284 and the carriage sensor 276 and 278 shown in FIG. 24, all of which are of the interruptible jet type aforementioned. The output of the sensor 284 is connected by a fluidic diaphragm amplifier 334 of a type as aforementioned to the feed control logic 308 from which output signal commands are fed to the turntable control logic 310 and to a fluid actuated control valve 340. The output of feed control logic 308 through amplifier 336 and a time delay 342, actuates the control valve 340 after a predetermined signal delay has occurred. Time delay components for fluidic air pressure signals are well known such as the time delay module utilized in one embodiment of the present invention manufactured by the C.

A. Norgren Co. and designated by Model No. 5TD-214-000. By means of the time delay, feeding movement of the carriage is delayed to insure completion of the container loading operation. The output ports of the control valve 340 are connected to opposite sides of the air cylinder device 206 for operating the carriage assembly through the rack and pinion drive mechanism 216. The opposite limit positions of the carriage mechanism are detected by the sensors 276 and 278, the outputs of which are fed through fluidic amplifiers 344 and 346 to a feed control valve 348 by means of which the air cylinder devices 242 of the feed control mechanism 226 are simultaneously operated. Fluid pressure for operating the air cylinder devices 242 and 206 is derived from the valve operating supply line 330 aforementioned in connection with FIG. 23. This fluid pressure is also supplied to the turntable operating air cylinder device 176 under control of the control valve 350 which receives valve actuating pressure from the turntable control logic 310. Operation of the turntable assembly is synchronized with the door assembly for the accumulator section and the feed mechanism by means of input signals fed to the turntable control logic from the door control logic and from the feed control logic as aforementioned in connection with FIG. 22.

Figure 25:
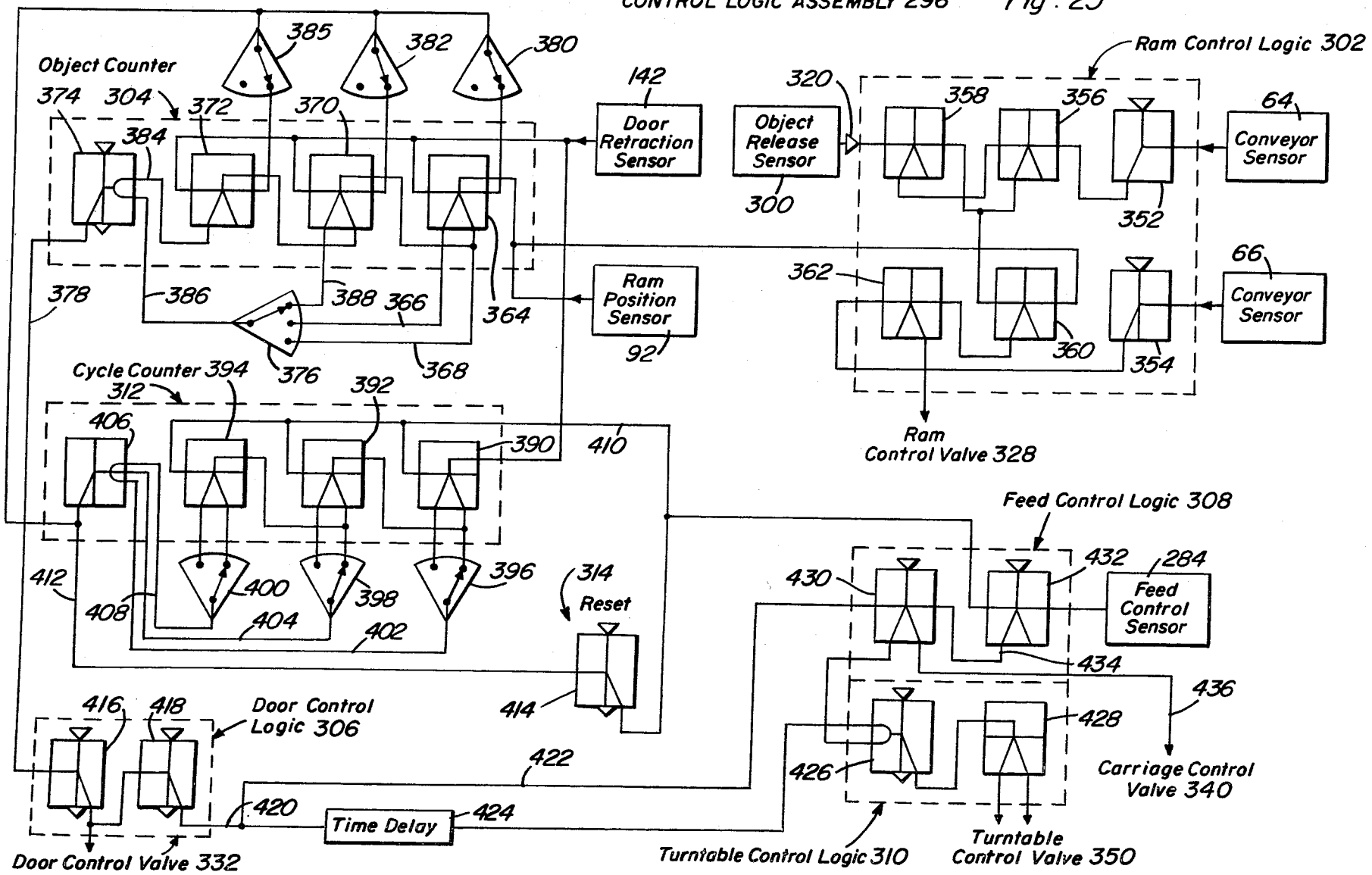
FIG. 25 is a circuit diagram of the fluid control logic assembly associated with the present invention.

FIG. 25 illustrates the control logic assembly which includes the ram control logic 302, the object counter 304, the cycle counter 312, the reset control logic 314, the door control logic 308 and the turntable control logic 310. Each of the foregoing control logic components in the illustrated embodiment, is made up of fluidic logic modules that are commercially available and manufactured for example by the C. A. Norgren Co. as aforementioned in connection with the various fluidic sensors, fluidic amplifiers, and time delay devices. The ram control logic component consists of a pair of OR-NOR modules 352 and 354 to which input signals are fed from the conveyor sensors 64 and 66 respectively. Also associated with the ram control logic component are four FLIP-FLOP modules 356, 358, 360 and 362. An input signal applied to the OR-NOR module 352 from sensor 64 produces a monostable action switching a fluid pressure flow signal to an output of module 352 connected to the signal input of FLIP-FLOP module 356. The FLIP-FLOP module like the OR-NOR module is basically a wall attachment device arranged to obtain a bistable action characteristic of a flip-flop function. Accordingly, an input signal at one of the inputs of the FLIP-FLOP module 356 from the OR-NOR module 352 will produce an output pressure signal at one terminal of FLIP-FLOP module 356 connected to one of the inputs of FLIP-FLOP module 356 connected to one of the inputs of FLIP-FLOP module 358 and one of the inputs of FLIP-FLOP module 360. When an input signal form sensor 66 is received by the OR-NOR module 354, the module 354 momentarily switches fluid flow so as to obtain a fluid pressure signal applied to one of the inputs of the FLIP-FLOP module 362 in order to produce an output signal that is fed to the ram control valve 328 for operating the ram which displaces each bird received in the receiver to the accumulator section. The FLIP-FLOP module 362 is operative to be switched to a condition in which it produces an output fed to the ram control valve only if a signal from sensor 66 is applied and no input signals are applied to the other input of FLIP-FLOP module 362 from the output of FLIP-FLOP module 360. No output is applied from FLIP-FLOP module 360 if it is switched to a zero condition by an input from the output of FLIP-FLOP module 356 that occurs whenever it is switched by an input signal derived from the sensor 64 as aforementioned. The FLIP-FLOP module 356 is switched to its zero state by the signal from sensor 64 and remains in this state only if no signal is fed to the other input of FLIP-FLOP module 356 from the FLIP-FLOP module 358. The FLIP-FLOP module 358 is conditioned to this zero state by a signal received from the object release sensor 300. Accordingly, it will be apparent that a command is supplied from the ram control logic 302 to the ram control valve 328 only when signals are received from the object release sensor followed by signals from the conveyor sensors 64 and 66 located a short distance downstream from the object release sensor along the conveyor associated with the weight sizing apparatus 12 to delay issuance of the command. Once the ram is operated in order to displace a bird into the accumulator section, a signal is produced by the ram position sensor 92 that is not only applied to the object counter 304 but also to one of the inputs of the FLIP-FLOP module 360 in the ram control logic component 302. This input signal switches the FLIP-FLOP module 360 to its other state feeding a signal to one of the inputs of the FLIP-FLOP module 362 switching it to its zero state causing retraction of the ram by removal of the valve actuating signal from the ram control valve 328.

Each time a signal is produced by the ram position sensor 92 reflecting the displacement of a bird into the accumulator section, it applies a signal to the input of the first binary counter module 364 in the object counter 304. The signal output of sensor 92 constitutes a toggle input applied to the binary counter module 364 which causes it to change its output state in order to switch the output signal therefrom between output lines 366 and 368. The output of binary counter module 364 to which output line 368 is connected, is connected to the toggle input of the second binary counter module 370. One output of the binary counter module 370 is connected to the toggle input of the third binary counter module 372. All three binary counter modules of the object counter 304 are therefore connected in tandem to one input of an AND-NAND module 374, the other input of which is connected to a count selector 376. The AND-NAND module 374 has a monostable action arranged to switch to an unstable condition providing an output in line 378 whenever signals are simultaneously present at both of the inputs. The object counter is conditioned to count the signal pulses supplied to the toggle input of the first module 364 from the ram position sensor 92 by set signals supplied to each of the binary counter modules from associated supplemental count selectors 380, 382 and 384 shown in the "on" positions in FIG. 25. A count of the signals from the sensor 92 will proceed through the binary counter modules producing an output in lines 384 from the third module 372 to one input of the gate module 374. When the output in line 384 coincides with the output in line 386 from the count selector 376, a signal pulse will be fed through line 378 from the object counter to the door control logic 306 in order to effect transfer of the predetermined number of birds received within the accumulator section as aforementioned. The predetermined number counted is determined by the count selector 376 having three operative positions in which the input line 386 to the gate module 374 is selectively connected to one of the output lines 366 and 368 of the first binary counter module 364 or one of the output lines 388 of the second binary counter module 370 in order to determine the number of signal pulses counted before outputs appear simultaneously in the input lines 384 and 386 to the gate module 374. When the transfer of the preselected number of birds is effected, a reset signal is produced by the door retraction sensor 142 and applied to the reset pins associated with each of the binary counter modules 364, 370 and 372 as shown in FIG. 25, in order to reset the counter and condition it for another counting operation.

The cycle counter 312 is similar in arrangement of modules to that of the object counter 304 in that it includes three binary counter modules 390, 392, and 394 interconnected in tandem. The toggle input to the first binary counter module 390 is connected to the door retraction sensor 142 so that the counter 312 may count the number of transfers made from the accumulator section to the underlying container on the turntable assembly. Further, both of the outputs of each binary counter module of the cycle counter 312, are connected to an associated one of the three, two position count selectors 396, 398 and 400. Either output of the first and second binary counter modules are selectively connected by the associated count selectors 396 and 398 through output lines 402 and 404 to two of a three input, AND-NAND gate module 406. The count selector 400 associated with the third binary counter module 394 is connected by output line 408 to the third input of the gate module 406. A reset signal is applied simultaneously to each of the binary counter modules of the cycle counter 312 through reset line 410 from the reset logic 314 in order to terminate operation of the cycle counter 312. When a predetermined number of signal pulses from the sensor 142 are counted by the cycle counter 312 as preselected through the count selectors 396, 398 and 400, output signals will appear simultaneously in output lines 402, 404 and 408 in order to effect a monostable switching action in the gate module 406 producing an output signal in line 412 which is fed back as a set signal to the selectors 380, 382 and 385 associated with the object counter 304. The output of the cycle counter 312 is also fed by the output line 412 to the reset logic 314 which comprises an OR-NOR module 414. Thus, the preselected output count of the cycle counter 312 is operative through the reset module 414 to supply a reset signal through line 410 to the binary counter modules of the cycle counter 312 in order to terminate its counting operation, a set signal to counter 304 so as to continue its operation as well as to supply an input signal to the feed control logic 308.

The signal fed from the object counter 304 through output line 378 to the door control logic 306, is applied to the input of its first OR-NOR module 416 connected in series with a second OR-NOR module 418 to produce an output signal in line 420 following the supply of an output signal from the first module 416 to the door control valve 332 as aforementioned. The output signal from the door control logic 306 in line 420 is fed to the feed control logic 308 and the turntable control logic 310 respectively through lines 422 and a time delay component 424. The input signal to the turntable control logic 310 is delayed by component 424 in order to insure completion of the transfer of birds to the container before it is re-orientated by operation of the turntable assembly.

The input to the turntable control logic from the door control logic through the time delay component 424, is applied to one input of an AND-NAND module 426 in the turntable control logic 310. The other input to the AND-NAND gate module 426 is received from the feed control logic 308 arranged to produce an output from the gate module 426 every time an input is applied from the door control logic except when the transfer of birds, represented by the output signal from the door control logic, corresponds to completion of the loading of the container on the turntable assembly. Thus, ordinarily each signal transferred to the turntable control logic 310 from the door control logic 306 produces an output signal from the gate module 426 that is applied to the toggle input of a binary counter module 428 producing a change in its output in order to effect angular movement of the turntable assembly in one direction or the other through one of the two outputs of the module 428 connected to the turntable control valve 350 as aforementioned in connection with FIG. 24.

As aforementioned in connection with the door control logic 306, each transfer of a preselected number of birds from the accumulator section is accompanied by a signal output from the door control logic in output line 422 which is applied to one of the inputs associated with a FLIP-FLOP module 430 in the feed control logic 308. The signal in line 422 will accordingly and normally produce an output from the module 430 which is applied to one of the inputs of the gate module 426 of turntable control logic 310 in order to condition the turntable control logic for operation of the turntable control valve and the turntable assembly in order to effect reorientation of the container following transfer of birds thereto. However, when a predetermined number of transfers has occurred resulting in the production of a reset signal in line 410 from the reset logic 314, a signal is applied to one of the inputs of a second FLIP-FLOP module 432 in the feed control logic resulting in its change of state to produce a signal in output line 434 that is fed to the other input of the FLIP-FLOP module 430. A change in state is thereby effected in the FLIP-FLOP module 430 so that upon receipt of the next signal from the door control logic corresponding to a final transfer of birds to the container, no output is applied from the module 430 to the gate module 426 in the turntable control logic. Instead, a signal is then applied through output line 436 to the carriage control valve 340. Thus, following final transfer of birds to the container being loaded, no operation of the turntable assembly and reorientation of the container occurs. Instead, the carriage is then advanced in order to displace the loaded container from the turntable assembly and replace it by an empty container under control of the container engaging feed control mechanism 226. When the loaded container has been replaced by an empty container by means of the feed mechanism, a signal is produced by the feed control sensor 284 as aforementioned, which signal is applied to the other input of the FLIP-FLOP module 432 which thereby switches the module 432 back to its normal inactive state in preparation for the next container feed operation.

When a reset signal is produced from the reset logic 314, corresponding to the transfer of a preset number of rows or layers of birds to the container, each of the binary counter modules 390, 392 and 394 in the cycle counter 312 is reset. While the counting operation of the counter 312 is thereby terminated, the output signal in 412 is applied through selected ones of the selectors 380, 382 and 385 to the object counter 304 in order to set selected ones of the binary counter modules therein for operation during a continued supplemental count. It will therefore be apparent that after the counting operation of counter 312 is terminated, the object counter 304 continues to count a preselected number of pulses from the ram position sensor 92 less than the preselected count previously counted. Upon completion of this supplemental count, a signal is again produced in output line 378 of the object counter and fed to the door control logic 306 in order to effect a final transfer of birds to the container. As hereinbefore explained, this final transfer of birds to the container is not followed by any reorientation of the container but is instead followed by operation of the container feed mechanism. It will therefore be apparent that through the selectors associated with the counters 304 and 312, the control logic assembly may be conditioned for packing a preselected number of birds in each layer, a preselected number of layers and for a preselected number of additional birds less than the number in each layer which is to be loaded into the container prior to its automatic displacement from the container filling machine. It will be further apparent, that a plurality of machines 10 individually adjusted by its associated logic selectors may be positioned along a weight sizing drip line to automatically pack poultry released at different stations, in accordance with the different packing requirements and numbers associated with each weight range.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a container filling machine in which objects are compacted within a storage zone by strokes of a ram and objects accumulated within the storage zone are transferred to a container, a control system including first counter means for counting the strokes of the ram, means responsive to completion of a preset count by the first counter means for effecting said transfer of accumulated objects in the storage zone to the container, second counter means for counting a preset number of said transfers of compacted objects to the container, reset means responsive to completion of the preset count by each of the counter means for terminating operation of the counter means, means responsive to the completion of said preset count by the second counter means for continuing supplemental operation of the first counter means, and means responsive to a preset supplemental count by the first counter means for transferring the accumulated objects in the storage zone to the container to complete filling thereof.

2. The combination of claim 1 including means responsive to reset of the second counter means for reorientating the container in delayed response to said transfer of objects thereto.

3. The combination of claim 2 including container feed means for displacing the container in delayed response to the completion of said supplemental operation of the first counter means.

4. The combination of claim 3 wherein each of the counter means includes a plurality of binary modules, selector means connected to said modules for preselecting said preset count, gate means connected to the binary modules and the selector means for conducting an output signal upon completion of said preset count, and additional selector means connected to one of the counter means for preselecting the supplemental count.

5. The combination of claim 1 wherein each of the counter means includes a plurality of binary modules, selector means connected to said modules for preselecting said preset count, gate means connected to the binary modules and the selector means for conducting an output signal upon completion of said preset count, and additional selector means connected to one of the counter means for preselecting the supplemental count.

6. In combination with a weight sorting mechanism from which objects within a predetermined weight range are received, an automatic container filling machine comprising accumulator means for storing a predetermined number of objects received from the sorting mechanism, means for transferring said objects from the accumulator means to a container in response to accumulation of said predetermined number of objects, means for reorientating the container relative to the accumulator means following tranfer of said objects to the container, counter means for selecting said predetermined number of objects and the number of reorientations imparted to the container during a filling operation, and selector means connected to the counter means for terminating said filling operation in response to the transfer of a supplemental number of objects less than said predetermined number, from the accumulator means to the container.

7. In a control system for an automatic container packing machine, a pair of counter devices, signal input means connected to one of the counter devices for supply of input pulses thereto, control means for producing a pulse resetting said one of the counter devices in response to a preselected number of signal pulses counted, means connecting the control means to the other of the counter devices for counting a preselected number of resetting pulses from the control means, reset means responsive to a count of said preselected number of resetting pulses by the other of the counter devices for resetting thereof, and means responsive to said resetting of the other of the counter devices for setting said one of the counter devices to count a supplemental number of the input signal pulses different from said preselected number.

8. The combination of claim 7 wherein each of said counter devices includes a plurality of binary counter modules interconnected in series, an AND gate receiving signal pulses transmitted by said binary counter modules and selector means interconnecting the AND gate with the binary counter modules for producing an output signal in response to said count of the preselected number of pulses.

9. The combination of claim 8 including logic means connected to the counter devices for controlling events in the container packing machine in accordance with the coincidence and non-coincidence of the output signals from said counter devices, the output signals from the other of the counter devices being operative through the reset means to reset only the other of the counter devices.

10. The combination of claim 9 including conveyor means for transporting objects along a predetermined path of travel and sorting means for transferring a predetermined class of said objects to the container packing machine.

11. The combination of claim 10 including feedback signal means connecting the sorting means and the container packing machine to the input signal means and the control means respectively for producing said input and resetting pulses respectively counted by and resetting said one of the counter devices.

12. The combination of claim 7 including conveyor means for transporting objects along a predetermined path of travel and sorting means for transferring a predetermined class of said objects to the container packing machine.

13. The combination of claim 12 including feedback signal means connecting the sorting means and the container packing machine to the input signal means and the control means respectively for producing said input and resetting pulses respectively counted by and resetting said one of the counter devices.

* * * * *